US005481288A

United States Patent [19]

Keeling et al.

[11] Patent Number: 5,481,288

[45] Date of Patent: Jan. 2, 1996

[54] MODULATION SIGNAL AMPLITUDE ADJUSTMENT FOR AN INK JET PRINTER

[75] Inventors: Michael R. Keeling; Hillar Weinberg, both of Cambridge, England

[73] Assignee: Linx Printing Technologies PLC, England

[21] Appl. No.: 864,850

[22] Filed: May 6, 1992

Related U.S. Application Data

[62] Division of Ser. No. 469,496, filed as PCT/GB88/00927, Oct. 28, 1988, abandoned.

[30] Foreign Application Priority Data

Oct. 30, 1987 [GB] United Kingdom ..... 8725465

[51] Int. Cl.[6] ..... B41J 2/115

[52] U.S. Cl. ..... 347/80; 347/74; 347/78

[58] Field of Search ..... 347/73, 74, 75, 347/76, 78, 79, 80, 77

[56] References Cited

U.S. PATENT DOCUMENTS

| | | | |
|---|---|---|---|
| 3,761,941 | 9/1973 | Robertson . | |
| 3,981,019 | 9/1976 | Fujimoto et al. | 347/80 |
| 4,025,926 | 5/1977 | Fujimoto et al. | 347/80 |
| 4,270,133 | 5/1981 | Shimazawa et al. . | |
| 4,346,387 | 8/1982 | Hertz | 347/75 |
| 4,367,476 | 1/1983 | Sagae . | |
| 4,470,052 | 9/1984 | Lovelady | 347/80 |
| 4,535,339 | 8/1985 | Horike et al. . | |
| 4,616,234 | 10/1986 | Wint | 347/80 |
| 4,631,549 | 12/1986 | Braun et al. . | |
| 4,638,325 | 1/1987 | Schneider et al. . | |
| 4,847,631 | 7/1989 | Naruse et al. . | |

FOREIGN PATENT DOCUMENTS

| | | |
|---|---|---|
| 59-7058A | 1/1984 | Japan . |

*Primary Examiner*—Sandra L. Brase

*Attorney, Agent, or Firm*—Lerner, David, Littenberg, Krumholz & Mentlik

[57] ABSTRACT

A method is provided for adjusting the operating amplitude of a modulation signal which influences the separation of drops from an ink jet of an ink jet printer. The method includes (1) determining the phase relationship between the modulation signal and the instants when successive drops separate from the ink jet for a plurality of amplitudes of said modulation signal (2) identifying the amplitude of the modulation signal at a predetermined characteristic point in the function of the phase relationship with the amplitude from the magnitude of the change of the phase relationship with the change of the amplitude; and (3) selecting the operating amplitude for the modulation signal in accordance with the amplitude identified in step (2). An ink jet printer is also provided which has control means for identifying the predetermined point from the magnitude of change of the phase relationship between the modulation signal and the instants when successive drops separate from the ink jet with change in the amplitude of the modulation signal.

12 Claims, 12 Drawing Sheets

MODULATION SIGNAL AMPLITUDE ADJUSTMENT FOR AN INK JET PRINTER

This is a division of application Ser. No. 07/469,496 filed as PCT/GB88/00927, Oct. 28, 1988, now abandoned.

BACKGROUND

The present invention relates to ink jet printers. Some aspects of the invention have particular application to continuous jet ink jet printers. A continuous jet ink jet printer is one in which, during the printing of a pattern or character, drops of ink are provided continuously and the printer is arranged so that drops which are not desired to create printed dots do not strike the surface on which a character or pattern is being printed.

Ink jet printers are well known, and are shown, for example, in U.S. Pat Nos. 3,298,030, 3,373,437 and 3,569,275. Further prior art, illustrating aspects of ink jet printers an providing background to aspects of the present invention, is shown in "Ink jet Printing" M. R. Keeling, Phys. Technol., Vol. 12 pp 196, published in Great Britain by the Institute of Physics, and in U.S. Pat. Nos. 3,681,778, 3,562,761, 3,465,351, 3,736,593, 3,683,396, 4,032,928, 3,600,955, 3,787,882, 4,417,256, 4,368,474, 4,638,325, 4,367,476, 4,631,549, 4,628,329, 3,631,511, 3,827,057, 3,875,574 and 4,384,295. All of the above-mentioned prior art documents are incorporated herein by reference.

In practice, ink jet printers do not always provide perfect print quality. Additionally, most ink jet printers require the operator to perform adjustments which are not always easy to carry out correctly. These problems are related, in that poor print quality is sometime caused by failure of the operator to carry out adjustments correctly, or sometimes even to carry out adjustments at all.

Reasons for poor print quality in prior art ink jet printers include incorrect amplitude of a modulation signal provided to a transducer for controlling the break-up of the ink jet into droplets, failure to adjust the operating parameters of the control system of each individual printer to match the particular characteristics of the individual print head being used, damage to or misalignment of parts of the print head which have to be moved to perform adjustment, cleaning or other operations, failure to maintain the correct ink viscosity and pressure, failure to perform printer start-up and shut-down routines necessary for optimum performance, failure to compensate the charging signal provided to an ink droplet charging electrode for individual variations in the performance of charging circuits, ink jet to charge electrode coupling and the effect of nearby ink droplets on each other, and the failure to maintain the correct ink jet velocity.

Ink jet printers may also be inconvenient to operate. In addition to requiring operator adjustments as referred to above, prior art ink jet printers may require operator intervention to initiate special routines when there are printing difficulties, such as a routine to clear a blockage from an ink jet nozzle. The versatility of an ink jet printer is greatly enhanced if a range of print heads are available providing different ink droplet sizes and speeds, but it is normally possible to change the print head on an ink jet printer only with great difficulty if at all. Ink jet printers frequently fail to operate correctly due to simple faults correctable by the operator, and possibly caused by incorrect operator adjustments, but such faults may cause the printer to be out of operation for considerable periods owing to the time taken for service personnel to arrive in order to diagnose the nature of the fault and the particular corrective action needed.

Prior art ink jet printers are frequently also complicated and expensive devices. Where it is desired to provide substantially identical printers having different print head nozzle sizes, so as to provide different ink drop sizes and production rates, it has in the past been necessary to provide completely different ink jet forming and modulating devices, as each device tends to be specific to a particular nozzle size and frequency of ink jet modulation.

SUMMARY OF THE INVENTION

The illustrated embodiment of the present invention overcomes or reduces at least some of the problems set out above, amongst others.

In one aspect of the present invention, a method is provided of adjusting the amplitude of a modulation signal for a transducer in an ink jet printer by monitoring the effect of varying modulation signal amplitude on the phase of the break-up of the ink jet into droplets, so as to identify the modulation voltage at a characteristic point, and determine therefrom a suitable modulation voltage for operation of the printer.

According to another aspect of the present invention, the operation of an ink jet printer is controlled in accordance with data representing characteristics of the print head being used to form the ink jet.

In another aspect of the present invention, connections to components of a print head for an ink jet printer are encased in a sealing substance. This may serve, for example, to protect them from the environment and from relative movement at the point of connection which may damage the connection.

In another aspect of the present invention, ink pressure is controlled in response to ink jet velocity and ink viscosity is controlled in response to ink pressure.

In another aspect of the present invention, internal conditions of an ink jet printer are output in response to interrogation inputs. These outputs may be relayed to service personnel, e.g. via the telephone, to enable fault diagnosis to be made and corrective action suggested without any service personnel necessarily having to visit a mal-functioning printer.

In another aspect of the present invention, an ink jet printer automatically performs control sequences in response to certain conditions. For example, the printer may automatically perform a start-up sequence in response to a start signal, a shut-down sequence in response to a stop signal, or a nozzle clearing sequence in response to inputs from condition sensors which indicate that the nozzle may be blocked.

In another aspect of the present invention, an ink gun is provided having a tapering ink cavity and a transducer restrained from movement at a predetermined radius only, which ink gun may be operable at a variety of modulation frequencies. Thus, the gun may be useable with a variety of different jet-forming nozzles sizes. Preferably, the gun can be operated at frequences at which neither the ink cavity nor the transducer resonate.

In another aspect of the present invention the arrangement of dots to make up a printed character or other pattern is stored in a pattern memory and the charges to be applied to the ink drops to form dots at different dot positions are stored in a charge memory, the charge memory storing the different levels of charge needed to direct a drop to a given drop position depending on whether or not one or more other nearby drops are being directed to form printed dots.

In another aspect of the present invention, the charge provided to a charging electrode in a print head for an ink let printer is compensated to account for variations between individual charging circuits and variations in the operating characteristics of individual print heads.

In another aspect of the present invention, a simplified structure is provided for measuring ink jet velocity, in which the outputs of first and second ink drop detectors are provided to a common output line.

In another aspect of the invention, an ink jet printer automatically alters its state if it exceeds a threshold for the total aggregate time it may spend in a particular condition while an ink reservoir level sensor continuously indicates that the ink level is below a predetermined level. In this way, if an operator does not take corrective action after the ink level falls below the predetermined level, the printer can automatically avoid damage from too low an ink level.

Other aspects and preferred features of the present invention are disclosed in the claims appended hereto and in the description of the preferred embodiment.

BRIEF DESCRIPTION OF THE DRAWINGS

A preferred embodiment of the present invention, given by way of non-limiting example, will now be described with reference to the accompanying drawings, in which.

DESCRIPTION OF THE PREFERRED EMBODIMENT

OVERVIEW

Figure 1:
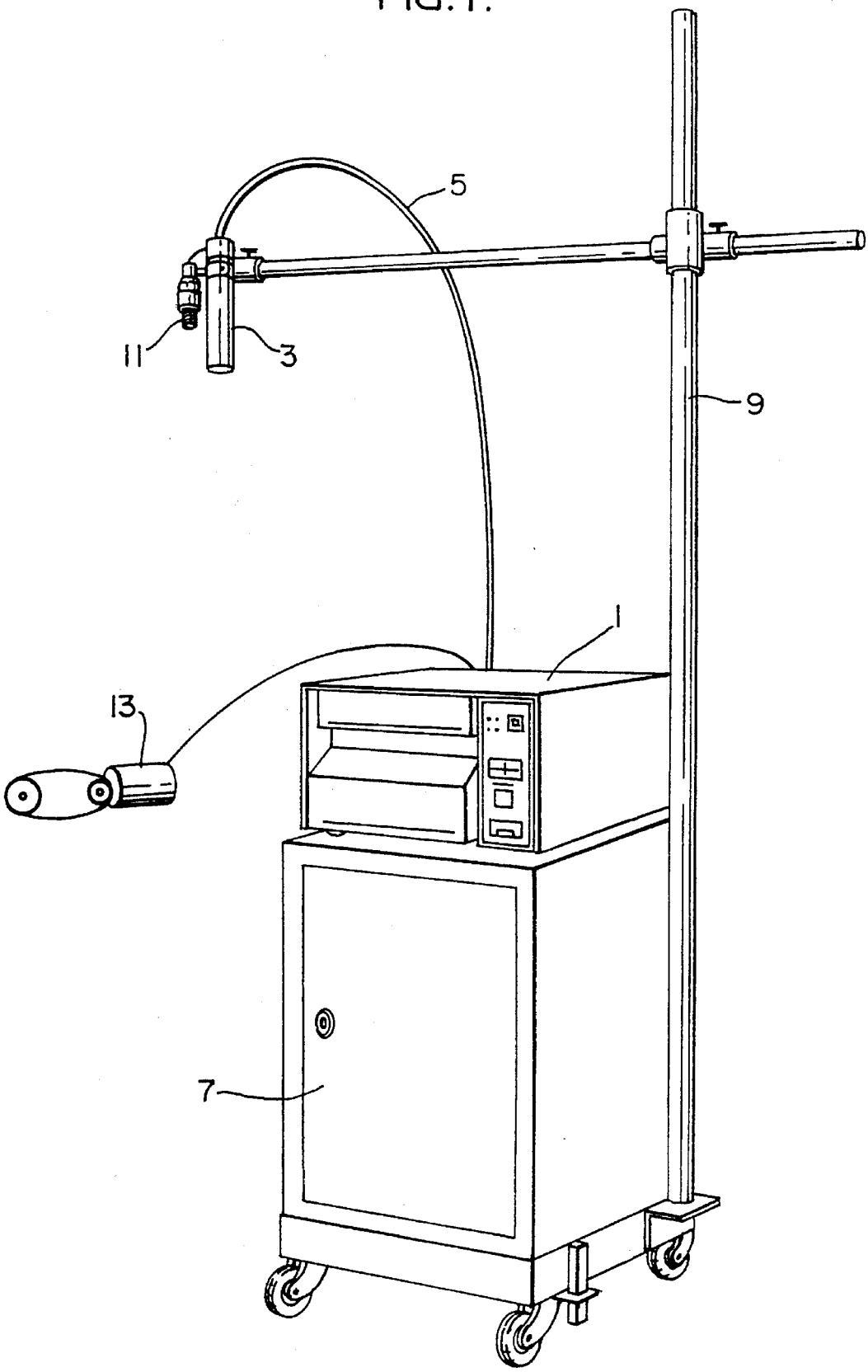
FIG. 1 is a view of an ink jet printer embodying the present invention.

FIG. 1 shows a typical arrangement of a preferred embodiment of the present invention in use. A main cabinet 1 of the printer is connected to a print head 3 by a conduit 5 which carries ink pipes and electrical connections. In the arrangement shown in FIG. 1, the main cabinet 1 rests on a movable storage unit 7, to which is fitted a gantry 9 which supports the print head 3.

In use, the arrangement of FIG. 1 would be positioned so that articles to be printed onto are carried so as to pass immediately below the print head 3. As the articles pass beneath the print head 3 the desired legend is printed on each article. In order to synchronise the printing operation with the passage of articles under the print head 3, the printer receives "print go" signals, indicating that printing onto the next article should commence, derived from a photo cell 11 mounted on the gantry 9 next to the print head 3, which detects the passage of articles past the print head. A shaft encoder indicated diagrammatically at 13, which is synchronised with the conveying mechanism which conveys articles to be printed past the print head 3, may also be used to control the timing of the printing operation, in association with or in place of the photo cell 11.

In the arrangement shown in FIG. 1, the printer is set up to print vertically downwards onto articles passing beneath the print head 3. However, it can alternatively be set up to print at any other angle including sideways and vertically upwards onto the underside of articles passing the print head.

The ink jet printer of FIG. 1 may be used for high speed printing in a variety of environments. Examples include printing decorative patterns onto food items, printing batch numbers directly onto pharmaceutical pellets, printing product numbers, batch numbers, expiry dates and information onto packaged pharmaceuticals, food packages such as milk cartons, jam jars, and shrink-wrapped packs, printing product identification text and codes onto product casings, printing text along the insulation of electrical cables, printing contents information on product bulk cartons, printing labels, and printing bar codes. Typically, the printed message may contain any combination of logos, dates, other text, bar codes, and automatically incrementing/decrementing data such as serial numbers.

The conduit 5 enables the main printer cabinet 1 to be placed at a convenient position, spaced from the printing location. For most purposes, a conduit length of 3 m will be suitable, but it may be longer or shorter as desired. However, as the conduit length is increased, care should be taken to ensure that compliance in the fluid tubes and capacitance of the signal lines does not adversely affect printer operation. Also, the vertical distance between the print head 3 and the main cabinet 1 affects the pressure needed by the gutter clearing system to suck ink back to the main cabinet 1.

Figure 2:
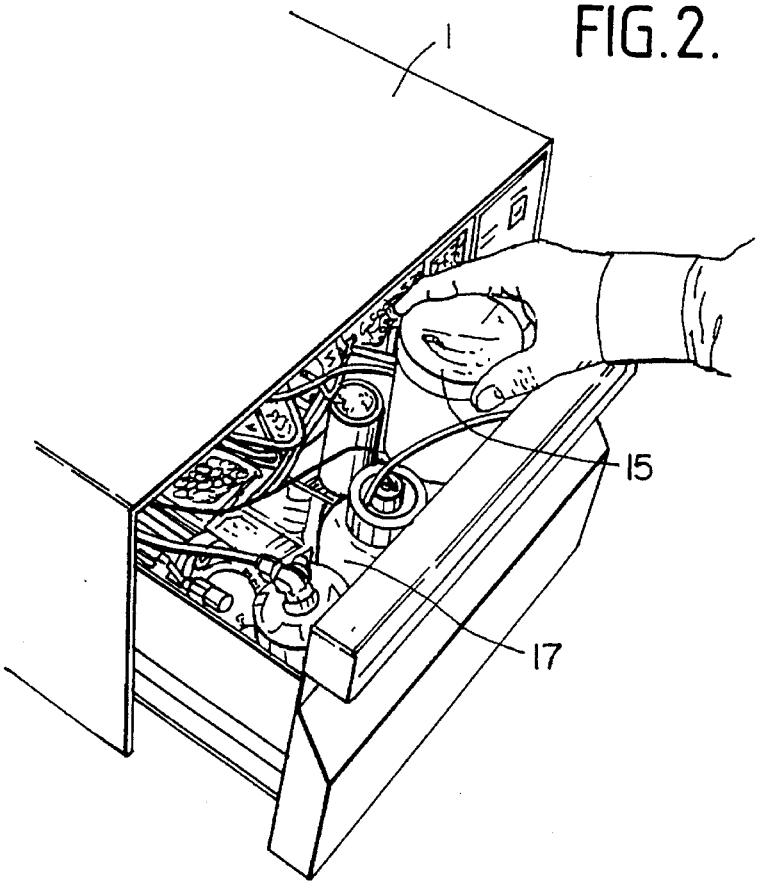
FIG. 2 is a view of part of the ink system of the embodiment of FIG. 1.

The main cabinet 1 of the printer contains a logic system, an ink system, and a power supply unit which receives mains electric power and provides the necessary power to the other systems. As is shown in FIG. 2, the ink system is mounted on a movable drawer, which may be pulled open by an operator to enable the ink supply and the solvent supply to be replenished, and to enable the main filter in the ink line to be replaced. The ink system is connected through flexible lines to connectors at the rear of the cabinet 1 for connection to the conduit 5, so that a fresh ink bottle 15 or a fresh solvent bottle 17 may be added while the printer is running.

Figure 3:
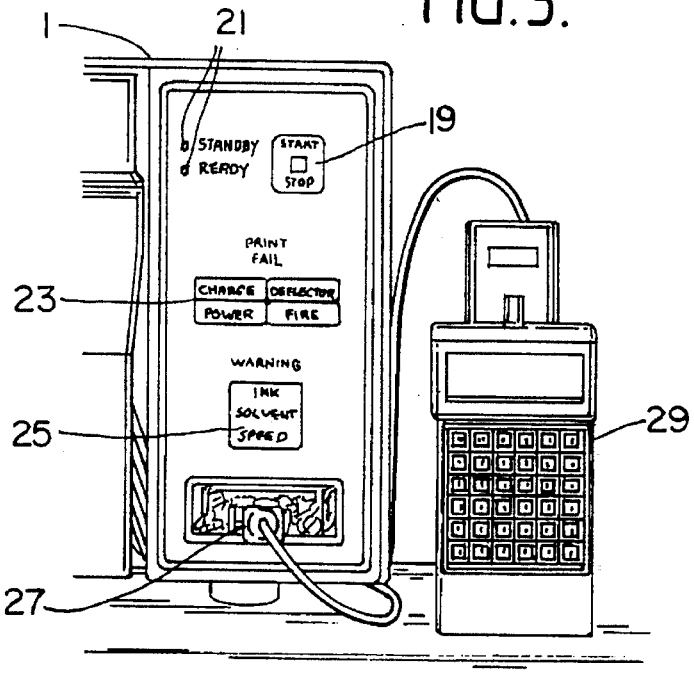
FIG. 3 is a view of the control panel and an input device for the embodiment of FIG. 1.

The logic system receives inputs from the photocell 11 and the shaft encoder 13 (if attached), and also receives inputs from and provides outputs to a control panel on the front of the main cabinet 1 as shown in FIG. 3. The control panel includes a start/stop button 19, mode indicator lights 21, a "print fail" display panel 23, which is used when the printer shuts down automatically to indicate the reason for the shut down, a "warning" display panel 25, which provides warnings to the operator, and an I/O terminal 27 for connection to a keyboard 29.

In use, a supervisor will typically use the keyboard 29 to input to the logic system the message to be printed, and the supervisor will then disconnect the keyboard 29 from the I/O terminal 27 and remove it. The start/stop button 19 is then the only control available to the operator. As will be described below, when the start/stop button 19 is pressed to start printing, the necessary start-up checks and adjustments are performed entirely automatically, without the need for the operator to perform any adjustments. This provides an improved ease of operation compared with known previous designs of ink jet printer, in which relatively unskilled operators are required to perform difficult fine adjustments on start-up to ensure good print quality.

In operation, the ink jet printer of the preferred embodiment operates generally as follows. The ink system supplies an appropriate mixture of ink and solvent to an ink gun within the print head 3, so as to create a jet of ink from a nozzle of the ink gun. The ink gun also contains a piezoelectric crystal, and the logic system provides a modulating voltage via a wire in the conduit 5 to the piezoelectric crystal, so as to provide a disturbance in the flow of ink through the ink gun which causes the jet leaving the nozzle to break up into ink droplets.

The print head 3 is arranged so that the point of break-up of the ink jet into droplets is within an electrical field created by a charging electrode, so that an electric charge is induced in the ink droplets as they are formed. The charge on each ink droplet depends to a first order on the voltage applied to the charging electrode at the instant at which that droplet breaks from the ink jet, and this is varied by the logic system in order to control the destination of each ink droplet.

The ink droplets then enter an electrostatic deflection field created between two deflection electrodes to which a constant deflection voltage typically of up to 10 kilovolts is applied. Each droplet is deflected by the deflection field to an extent determined by its charge. Droplets having a first level of charge, typically zero (i.e. undeflected), enter a gutter and are returned through a pipe in the conduit 5 to the ink system in the main cabinet 1. Other droplets, having different levels of charge, are deflected so as to pass the gutter and to leave the print head 3, and to form print dots on the object being printed on.

Sensors detect the passage of ink droplets through the print head, and are used to measure the speed of the ink jet (time of flight) and to monitor the charging of the ink droplets for the purpose of maintaining the correct phase relationship between the modulating signals applied to the piezoelectric crystal and the charging signal applied to the charge electrode.

It is a feature of the ink jet printer of the preferred embodiment that any of three different types of print head 3 may be connected to the main cabinet 1. Each print head 3 is fast with its conduit 5, and print heads are exchanged by disconnecting the conduit 5 from the main cabinet 1 and connecting in the conduit 5 of a different print head 3. The different types of print head have different nozzle sizes for their ink guns, have different frequencies of modulation of the piezoelectric crystal, and have different speeds of maximum relative movement between the articles to be printed onto and the print head 3.

In use, the print head is arranged so that the direction of deflection of the ink droplets is generally transverse to the direction of relative movement between the print head 3 and the articles to be printed onto, and printed characters and symbols are formed by a raster scanning process. Each of the three different types of print head has the same maximum number of drops in the raster.

It is desirable to provide a range of print heads for the following reasons. As is well known, for good break up of the ink jet into droplets, there is an optimum droplet pitch along the ink jet of approximately 4.51 times the diameter of the jet. This implies that there is a particular optimum droplet frequency for any given jet diameter and velocity. The frequency will be higher for smaller droplet diameters. Typically, the smaller the droplets, the better is the quality of the printing.

However, if relatively tall characters are to be printed using small droplets the number of droplets in the raster line must be increased. Since the frequency with which the droplets are formed is fixed, as the number of droplets per raster lane is increased the time taken to print each raster line is increased, and accordingly the maximum permitted relative speed of articles past the print head must be reduced to stop the shape of the characters from being stretched in the direction along relative movement. Accordingly, to permit printing onto high speed lines of articles the number of droplets in each raster line is limited and if greater character heights are desired the droplet size must be increased.

Additionally, the smaller the droplet, the smaller is the maximum flight path which can be used between the ink jet nozzle and the surface to be printed on, as aerodynamic drag and charge interactions between the droplets in the ink jet have a greater distorting effect on smaller droplets. Thus, the larger the droplet size the greater the maximum permitted spacing between the print head 3 and the articles to be printed on.

Furthermore, since droplets deflected by different amounts for different raster positions leave the print head at different angles, increasing the print head to article spacing increases the height of the printed character, which provides a further mechanism by which greater character print heights may be achieved with larger droplets.

Usable nozzle diameters (orifice diameters) are typically in the range of 10 to 250 micrometers. Where a range of three print heads is provided, the following sizes are convenient. The "micro" print head has a nozzle diameter of 20 to 40 μm, provides the smallest size drops and can print with raster heights approximately in the range of 0.8 mm to 7 mm. The "midi" print head has a nozzle diameter of 50 to 80 μm, produces somewhat larger ink droplets, and can print with a range of raster heights of approximately 2 mm to 15 mm. The "macro" print head has a nozzle diameter of 90 to 120 μm, produces yet larger ink droplets, and can print with raster sizes approximately in the range of 3 mm to 25 mm.

The detailed structure and operation of portions of the ink jet printer of the preferred embodiment will now be described. Some parts of its structure and operation are conventional and Will be well understood by those skilled in the art, and are therefore not described in detail.

INK SYSTEM

Figure 4:
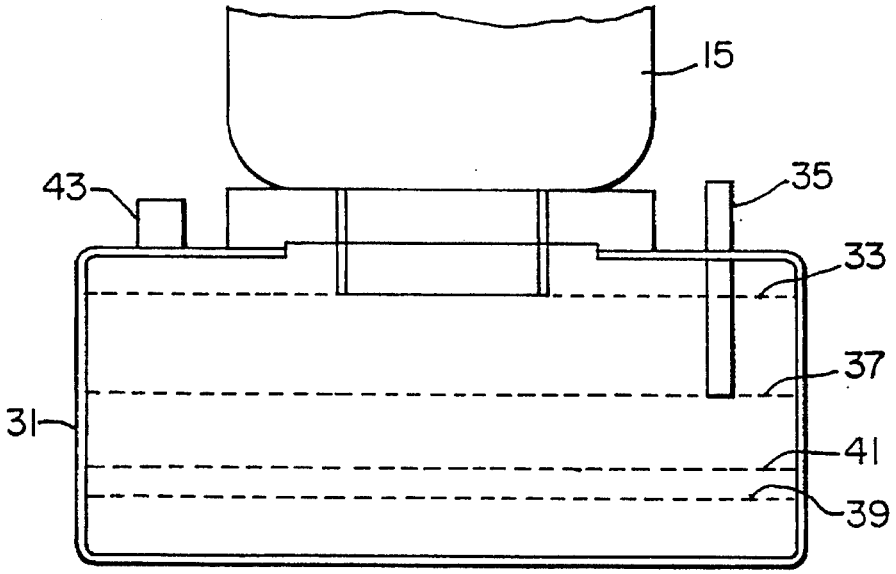
FIG. 4 is a diagrammatic cross-section of the ink reservoir of the embodiment of FIG. 1.

In the ink system the solvent bottle 17 sits upright, and acts as a solvent reservoir. Solvent is extracted when required by suction pressure as will be described below. However, the ink bottle 15 is mounted in the cabinet 1 in an inverted position and acts to top up an ink reservoir 31, as shown in FIG. 4.

Ink is extracted from the reservoir 31 by a pump. When mounted in inverted position on the ink reservoir 31, the mouth of the bottle 15 defines a "reservoir full" level 33. When ink is above this level, air cannot enter the ink bottle 15 and so no further ink can flow out of the bottle. As the ink falls below the level 33, air is admitted to the bottle 15 and ink flows out of the bottle to restore the ink level in the reservoir to the "reservoir full" level 33. Once all the ink in the bottle 15 has passed into the reservoir 31, the level of ink in the reservoir will begin to fall. A level sensor 35 senses when the ink reaches an "ink low" level 37. When this level is reached, the ink warning light on the warning display panel 23 (FIG. 3) will be turned on, to inform the operator that more ink should be added.

Even though the level of ink in the ink reservoir 31 has fallen below the "ink low" level 37, the printer will continue to operate, withdrawing ink from the reservoir. However, it is important that the printer should shut down before a danger level 39 is reached at which the ink pump begins to draw in air, as this might damage the pump. Accordingly, the machine is arranged to shut down automatically when the level of ink in the reservoir 31 reaches a "shut down" level 41.

The shut down level 41 is not sensed directly by level sensor. Instead, it is estimated by programming the printer to shut down after a predetermined period of further printing (i.e. further ink usage) after the "ink low" level 37 is reached. The period of further printing required to reduce the ink level from the "ink low" level 37 to the "shut down" level 41 will depend on both the rate of consumption of ink of the print head being used, and on the cross-sectional area of the ink reservoir 31. The three different types of print head referred to earlier use ink at different rates, so the period of further printing before shut down after the "ink low" level 37 is reached varies in accordance with which print head is being used. For any given print head and reservoir cross-section, the rate of ink level change with continued printing may be determined experimentally.

As will be explained later, a mixture of ink and air is returned to the reservoir 31 during operation of the printer. There is a tendency for solvent in the ink to evaporate into the air mixed with it, particularly if the ink has been warmed. Accordingly, an apertured boss 43 is provided on the ink reservoir 31, and a condenser (not shown) is mounted on the boss 43. Air carrying evaporated solvent passes through the boss 43 into the condenser, where it cools to ambient temperature and solvent condenses out. The solvent then trickles back into the ink reservoir 31. The air is vented through a small hole at the top of the condenser.

Figure 5:
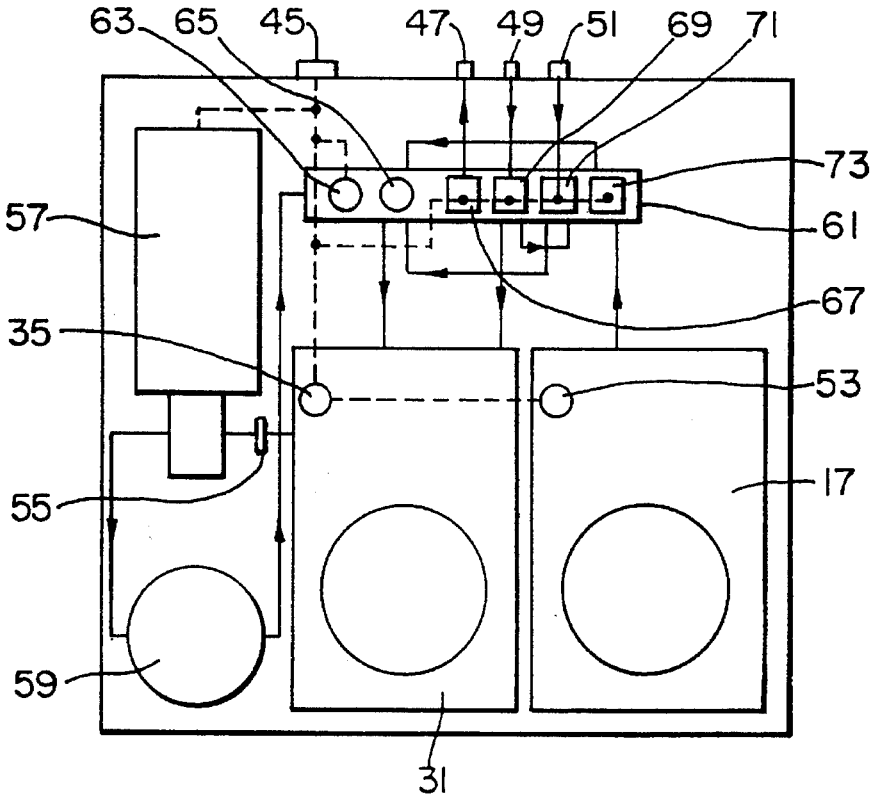
FIG. 5 is a diagrammatic view of the ink system in the main cabinet of the embodiment of FIG. 1.

FIG. 5 shows an overview of the ink system within the main cabinet 1 of the printer. Electric power is supplied to the ink system by the power circuitry through a power connector 45. The distribution of electric power within the ink system is shown in broken lines in FIG. 5. Fluid connectors 47, 49 connect the ink system of the main cabinet 1 to the ink gun in the print head 3, and a fluid connector 51 connects to a pipe in the conduit 5 leading to the gutter of the print head 3. The fluid paths in the ink system are shown in unbroken lines in FIG. 5. The main components of the ink system within the main cabinet 1, as shown in FIG. 5, are: the solvent bottle 17; a solvent level sensor 53; the ink reservoir 31; the ink level sensor 35; a pre-filter 55; a pump 57; a main filter 59; and a manifold 61. Mounted on the manifold are a pressure transducer 63, a suction device 65 and four valves 67, 69, 71, 73. The fluid interconnections between the portions of the entire ink system, including the gun 75 and gutter 77 of the print head 3, are shown in more detail in FIG. 6.

Figure 6:
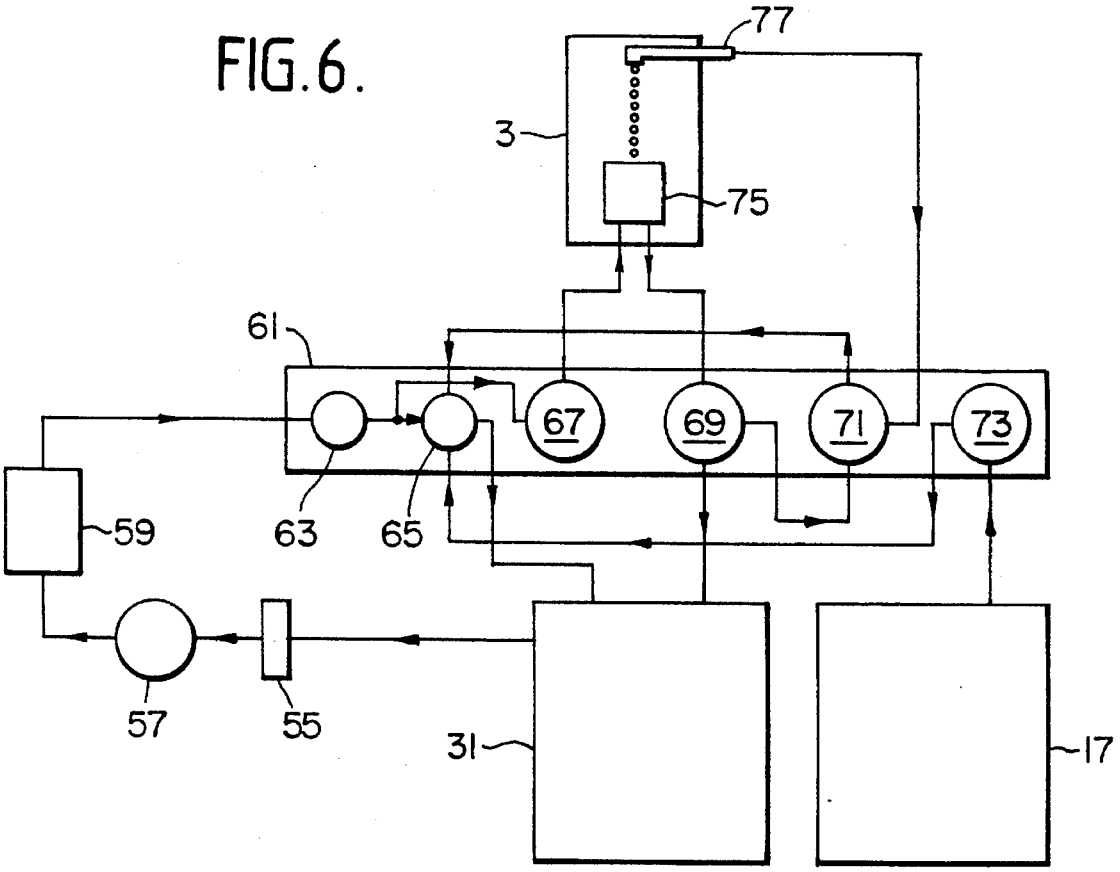
FIG. 6 is a flow path diagram of the ink system of the embodiment of FIG. 1.

Referring to FIG. 6, the pump 57 draws ink from the ink reservoir 31. The ink first passes through a pre-filter 55, which is a relatively coarse 30 micrometer filter which protects the pump from damage by any relatively large particles which may be present in the ink. The ink then passes through the main filter 59, which is a finer, 3 micrometer filter which protects the remainder of the ink system. As a further precaution, a further 3 micrometer filter (not shown) is provided in the print head 3 immediately upstream of the gun 75, to minimise the likelihood of particles in the ink causing a blockage of the nozzle of the ink gun 75.

From the main filter 59, the ink passes into the manifold 61 to the pressure transducer 63. This provides an electrical signal indicating the ink pressure, which is used in a feedback system to control the pump 57 so as to maintain the ink pressure at a level specified by the logic system. The pump control system will be described below. From the pressure transducer 63, ink flows to the suction device 65, and then returns at substantially atmospheric pressure to the ink reservoir 31.

This forms a closed loop ink path in which there are no valves, and ink flows around this path continually for as long as pump 57 is in operation. This ensures that suction device 65 operates continually to provide suction pressure at its low pressure inlets. As mentioned above, the ink returning to the reservoir 31 will typically be mixed with air. This air is drawn into the ink loop through the low pressure inlets of the suction device 65.

Ink also passes from the pressure transducer 63 to the first valve 67 (also called the feed valve), by-passing the suction device 65. When this valve is opened, ink is supplied to the ink gun 75. The second valve 69 (also called the purge valve) connects a return line (the purge line) from the ink gun 75 either to the ink reservoir 31 or to the third valve 71. The third valve 71 (also called the gutter valve) applies suction pressure from a low pressure inlet of suction device 65 either to the purge valve 69 or to the gutter 77 of the print head 3. The fourth valve 73 (also called the top-up valve) either isolates solvent bottle 17 or connects it to a second low pressure inlet of suction device 65, to enable the amount of solvent mixed in with the ink to be topped up.

Figure 7:
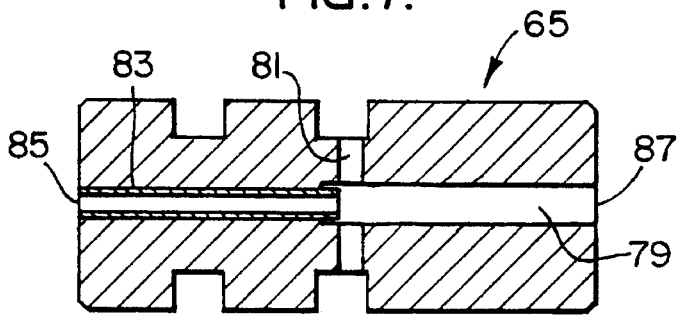
FIG. 7 is a cross-sectional view of the suction device of FIG. 6.

The construction of the suction device 65 is shown in FIG. 7. The suction device 65 has a unitary body e.g. of an inert plastics material. A first bore 79 extends longitudinally through the suction device. A second bore 81 extends across the suction device, crossing the first bore 79. A stainless steel tube insert 83 is fitted within part of the first bore 79, and ends immediately before the junction between the first bore 79 and the second bore 81. The insert 83 narrows the diameter of the free passage through the first bore 79. As shown in FIG. 7, the portion of the first bore 79 containing the stainless steel insert 83 may also be of reduced diameter. In this case, it is preferred that the reduced diameter portion of the first bore 79 ends slightly before the junction between the first bore 79 and the second bore 81, so that the end of the stainless steel insert 83 projects slightly into the wider diameter portion of the first bore 79, as is shown in FIG. 7.

One end 85 of the first bore 79 is connected to the high pressure ink supply from the pressure transducer 63. The other end 87 of the first bore 79 is connected to the ink and air return line to the ink reservoir 31. Therefore, high pressure ink enters the first bore 79 and flows through the restricted diameter stainless steel insert 83, to the junction between the first bore 79 and the second bore 81. At this junction, the ink stream enters the wider diameter portion of the first bore 79, and expands to fill the bore, while the pressure of the ink stream reduces. The fast flowing ink stream, expanding from the end of the stainless steel insert 83, passes the openings of the second bore 81 into the first bore 79, and accordingly tends to suck any air or other fluid in the second bore 81 into the ink stream. In this way, continued flow of ink through the first bore 79 will maintain a suction pressure at both ends of the second bore 81. The two ends of the second bore 81 are connected to the third valve 71 and the fourth valve 73 respectively.

As will be explained later, the suction effect of suction device 65 may be used to withdraw ink from the print head 3 along the conduit 5. If the print head 3 is positioned below the main cabinet 1 of the printer. the suction effect of the suction device 65 may be required to lift a substantial column of ink (the conduit 5 may be 3 m long, as described above). Accordingly, it is preferred that the suction device provides at least 2 psi suction pressure below atmospheric to the ends of the second bore 81. More preferably, the suction pressure is at least 5 psi below atmospheric. However, preferably the suction pressure is not substantially greater than about 10 psi below atmospheric, as this will lead to excessive suction of air into the ink stream, promoting an increased loss of solvent through evaporation.

Suction device 65 is advantageous because it has a simple construction with no moving parts, and is cheaper than providing a second pump to create the required suction pressure.

VALVE AND PUMP CONTROL

Figure 8:
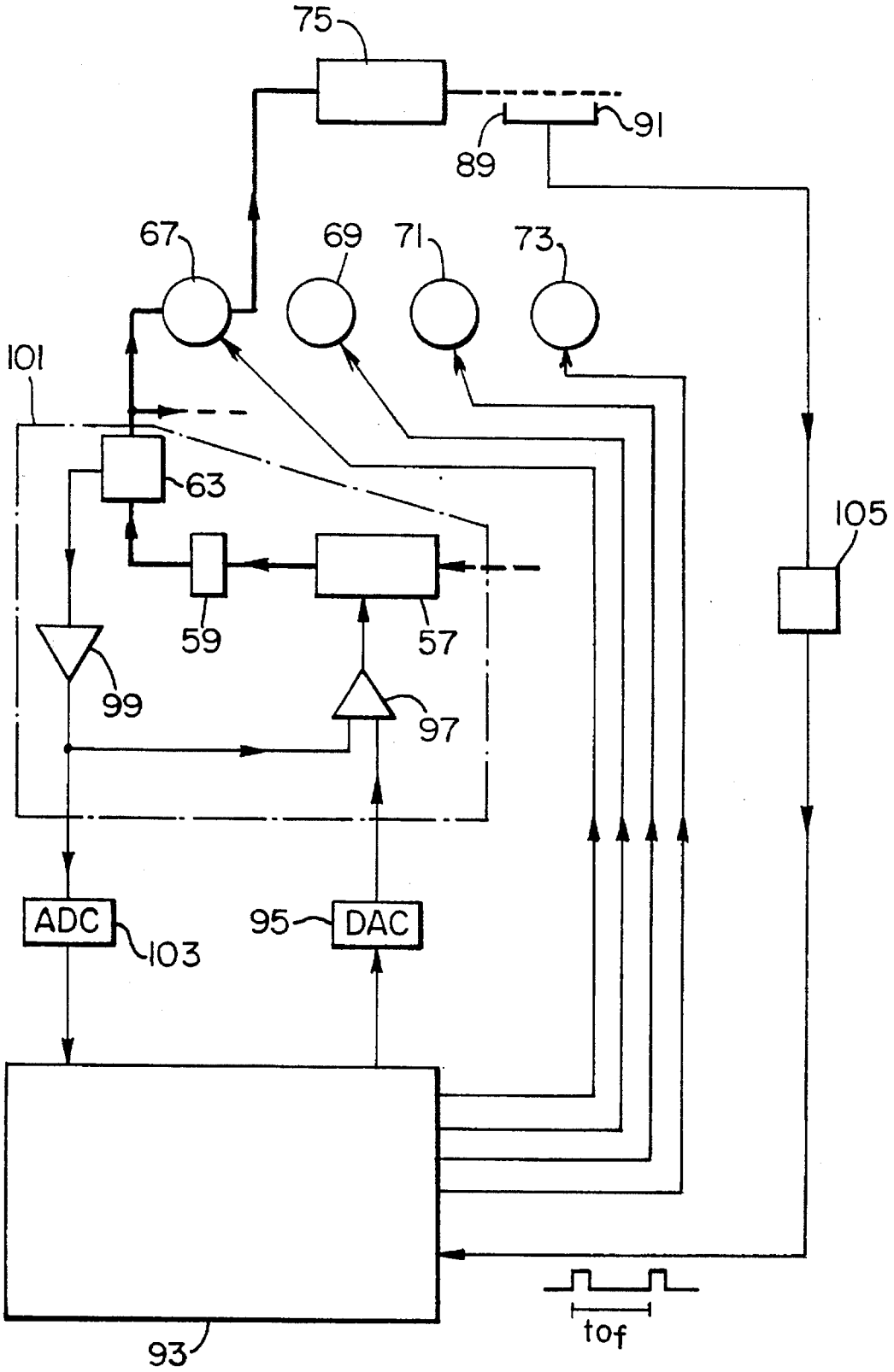
FIG. 8 is a diagrammatic view of the pump and valve control arrangement of the embodiment of FIG. 1.

FIG. 8 shows the valve and pump control system. The Figure shown a portion of the ink flow path in bold line, showing ink entering the pump 57, passing through the main filter 59 to the pressure transducer 63, and then through the first valve 67 to the ink gun 75. The ink jet leaving the gun 75 passes a phase sensor 89 and a time of flight (tof) sensor 91.

As will be described in more detail later, the sensors detect the passage of charged ink droplets, so that if a packet of charged droplets is provided in a stream of otherwise uncharged droplets a pulse will be output first by the phase sensor 89 and then by the time of flight sensor 91. The time period between the two pulses equals the time taken for the ink droplets to travel the distance between the two sensors 89, 91, (known as the "time of flight"), and thus this time is a measure of ink jet speed.

The pulses from the phase sensor 89 and the time of flight sensor 91 are shaped and conditioned by a wave shaper 105, to produce pulses suitable for supply to the logic system 93. Preferably, the wave shaper 105 comprises a comparator so that an output is provided to the logic system 93 only while the input to the wave shaper 105 exceeds a threshold value. Thus the pulses from the sensors 89, 91 are shaped to become square wave pulses. The output level of the comparator is selected to be compatible with the input circuits of the logic system 93 (e.g. TTL).

The logic system 93 recieves the pulses from the phase sensor 89 and the tof sensor 91, and is thereby enabled to measure the current time of flight. For example, the logic system may start an internal counter when the first pulse is received, increment the counter at a constant predetermined clock rate, and stop the counter when the second pulse is received. The outputs of the phase sensor 89 and the tof sensor 91 are wired together, and are input to a common wave shaper circuit 105 and hen to a common input of the logic system 93. In this way, the need for two wave shaper circuits is avoided. The logic system 93 does not need to receive the outputs from the sensors on separate lines, as the first pulse of a pair will always come from the phase sensor 89 and the second pulse will come from the tof sensor 91.

The logic system 93 outputs a pressure request in the form of a number between 0 and 255 to digital-to-analogue converter 95, which represents the pressure which the pump 57 is required to provide. The maximum count value, 255, represents pressure of about 65 psi. The DAC 95 converts the pressure request number to an analogue signal, which is supplied to the pump 57 as a control signal through an error amplifier 97.

Pressure transducer 63 provides an analogue output representing the pressure of the ink flowing through it, and this is amplified in an amplifier 99 to convert it to the same scale as the analogue output of the DAC 95. The amplified pressure transducer output is also supplied to the error amplifier 97. The error amplifier 97 controls the operation of the pump 57 so as to minimise the difference its two inputs.

The error amplifier 97 is arranged to have a slow response, to avoid overshoots and "hunting" of the pressure value due to the delay in the response of the pressure transducer output to changes in the pump speed. Accordingly, it can be seen that the components within the chain dotted line 101 form an analogue feedback loop which controls the pump in accordance with the output of the pressure transducer 63 so as to maintain the pressure at the value specified by the pressure request number supplied from the logic system 93 to the DAC 95. The analogue feedback loop 101 maintains a stable pump pressure, and compensates automatically for the effect of wear in the pump and any pressure loss across the main filter 59.

The output of the amplifier 99 is also supplied to an analogue-to-digital converter 103, which converts the amplified output of the pressure transducer 63 to a digital value, which is provided to the logic system 93. This provides a means of testing whether the pressure obtained in fact matches the pressure requested by the logic system 93. The output of the ADC 103 is used only for testing and diagnostic purposes, and is not used for pressure control.

As will be explained in greater detail below, for any given print head 3, the logic system 93 is provided with a target time of flight value. When the measured time of flight value is different from the target value, the logic system 93 alters the pressure request value supplied to the DAC 95, so as to alter the pressure of the ink supplied to the ink gun 75. In this way, the ink pressure is adjusted to maintain the time of flight at the target value.

It is preferred that the logic system 93 alters the pressure request number by a fixed increment in response to an off-target measured time-of-flight. However, as an alternative, the logic system 93 could select the amount by which to change the pressure request number in accordance with the amount of the difference between the target and the measured time-of-flight values.

As will be explained in greater detail below, the logic system 93 is also supplied with a target value for the pressure request number. This value represents the ink pressure required to provide the correct time of flight when the ink viscosity is at a particular chosen level, which is the preferred viscosity level for printing. This level will normally be in the range 2 to 50 centipoise, more typically in the range 2 to 8 cp. For the sake of example, it will be assumed hereinafter that the preferred viscosity level has been chosen as 3 cp. If the pressure request value necessary to maintain the correct time of flight exceeds the target pressure request value by more than a predetermined threshold, the logic system 93 enters a "solvent top-up" routine in which the fourth valve 73 is opened.

Suction pressure from the suction device 65 is then applied to the line leading from the solvent bottle 17, and solvent is sucked into the ink passing through the suction device 65, and therefore is added to the ink in the ink reservoir 31. The addition of solvent reduces the viscosity of the ink. Preferably, the threshold value for the pressure request number is calculated to represent the pressure required to maintain the correct time of flight when the ink viscosity exceeds the preferred level by a threshold value. The threshold value may conveniently be 0.5 cp above the preferred level, at least where the preferred level is not more than about 5 cp, but other values may be used. For the sake of example, it will be assumed that the threshold value is 3.5 cp. Thus, in normal operation the ink viscosity is maintained at no more than 3.5 cp.

The logic system 93 will not enter the "solvent top-up" routine during an initial warm-up and settling period after start-up of the printer. This allows time to mix in any fresh ink which may have been added while the printer was stopped, and time to allow the ink temperature to stabilise (ink temperature affects viscosity). This initial period will conveniently be in the range 30 minutes to an hour.

As will be described in more detail below, each individual print head 3 is preferably calibrated to determine the particular values of time of flight and pressure request which provide the best quality of printing with that particular print head. However, if a new print head 3 is fitted to the printer, and the calibration values for the new print head are not entered into the logic system 93, the logic system will use default values which approximate to the expected calibration values. For the micro and the midi print heads, the default target pressure request number is 196. For the macro print head, the default target pressure request number is 75. The default target values for time of flight are selected to be equivalent to ink jet velocities in the range 10 to 25 meters per second, the precise value being selected in accordance with nozzle diameter.

The pressure request threshold value, at which a "solvent top-up" routine is initiated, is a value 5 above the target pressure request number for the micro print head, 4 above the target pressure request number for the midi print head and 3 above the target pressure request number for the macro print head.

In addition to the run mode and the "solvent top-up" routine referred to above, the logic system 93 also controls the pump 57 pressure and the valves 67, 69, 71, 73 to perform a start up sequence, a shut down sequence and a "nozzle clear" routine. The valve sequences and the pressure control will now be described in more detail.

PRESSURE CONTROL AND VALVE SEQUENCES

These will be described with particular reference to FIGS. 6 and 8. Appendix A hereto provides tables of the valve patterns used, and the valve sequences used in the various operational modes.

a. Start-up i) Typically, this mode is entered by the operator pressing the start/stop button 19 (FIG. 3).

ii) The valves remain in pattern O "stand-by". The pump 57 starts and the logic system 93 provides a pressure request number to the DAC 95 of 225 (filter test number). The logic system 93 waits for three to five seconds for the pressure in the ink system to stabilise.

ii) The logic system 93 then reads in the sensed pressure number from ADC 103. If the number read from ADC 103 is less than the pressure request number and the difference between the numbers is more than fourteen, the logic system 93 determines that the main filter 59 is blocked to a significant extent, and uses the warning display panel 25 (FIG. 3) to warn the operator that the filter 59 should be changed.

iv) The logic system 93 then sets the valves in valve pattern 1 "run", while providing a "jet start" pressure request number to DAC 95. The "jet start" pressure request number is 255 (i.e. maximum) for the micro and midi print heads, and is 200 or a little less for the macro print head. These pressures are significantly more than the normal running pressures of the print heads, and provide a brief period of high pressure at the moment when the jet is started. The logic system 93 waits for three to five seconds for the jet to stabilise.

v) The logic system 93 sets the valves in pattern 2 "purge", so as to purge air out of the ink gun 75. The pressure request number is maintained at the "jet start" level during this period. The purge state is maintained for about three to five seconds.

vi) The logic system 93 reduces the pressure request number to the target run level for the print head being used and returns the valves to pattern 1 "run". The logic system 93 next performs a phasing routine, as will be described below, and then tries to adjust the pressure request number to obtain the correct time of flight. If correct phasing and time of flight cannot be obtained, the logic system 93 assumes that the nozzle of the ink gun 75 is blocked. Normally, it will then enter the "nozzle clear" mode. However, if it enters the nozzle clear mode three times in succession from the start-up mode without having successfully entered the run mode, and correct phasing and time of flight cannot be achieved a fourth time, the logic system 93 enters the shut down mode automatically. If correct phasing and time of flight can be achieved, the logic system 93 enters the run mode.

b. Run i) In this mode, the valves are always in valve pattern 1 "run". As described above under "Valve and Pump Control", the logic system 93 adjusts the pressure request number supplied to the DAC 95 so as to maintain the correct time of flight. If the pressure request number exceeds the target pressure request by more than a threshold value, the logic system 93 enters the "top-up" mode, except during the initial warm-up and settling period as described above.

c. Nozzle Clear i) This mode is entered with the valves in valve pattern 1 "run" when it has not been possible to obtain correct phasing and time of flight in step vi of the start-up mode.

ii) The logic system 93 brings the valves into pattern 3 "nozzle suction", so as to clear any nozzle blockage. At the same time, the pressure request number supplied to DAC 95 is increased to the "jet start" number so as to provide increased suction pressure from the suction device 65. This state is maintained for ten to fifteen seconds.

iii) The valves are then switched to pattern number 0 "stand-by", and the logic 93 returns to the beginning of the "start-up" mode.

d. Shut Down i) This mode is entered with the valves in pattern 1 "run", either as a result of automatic shut down for any reason or by the operator pressing the start/stop button 19 (FIG. 3). Automatic shut down may occur following three unsuccessful "nozzle clear" sequences, if the ink reservoir 31 is not topped up within a predetermined period after the "ink low" level 37 (FIG. 4) is detected, if the EHT supply to the deflection plates trips, if the voltage supply to the charge electrode fails, if the logic system 93 can no longer maintain correct time of flight, or if the print head overheats.

ii) The logic system 93 sets the valves to pattern 3 "nozzle suction". This stops the supply of ink to the ink gun 75 while simultaneously applying suction to the gun to provide a positive jet stop. The pressure request number supplied to the DAC 95 is raised to the "jet start" level, to provide increased suction pressure from the suction device 65 to the ink gun 75. This state is maintained for about 0.5 seconds.

iii) The logic system 93 then de-energises all valves so that they return to pattern number 0 "stand-by". The pressure request number is maintained at the "jet start" level and the pump 57 continues to run so that suction from the suction device 65 clears ink front the gutter 77 and the gutter line in the conduit 5. This reduces the tendency for the gutter 77 or the gutter line to become blocked with dried ink while the printer is stopped. This state is maintained for 30 seconds.

iv) Pump 57 is stopped.

e. Top-Up i) This state is entered from the run mode, with the valves in pattern number 1 "run".

ii) The valves are switched to pattern number 4 "top-up" and solvent is sucked into the ink line from the solvent bottle 17. This state is maintained for a period which has been determined to allow a preset volume of solvent to be withdrawn from the solvent bottle 17. The precise period will depend on the parameters of the ink system, such as the suction pressure applied by the suction device 65. Typically, the period will be of the order of 15 seconds.

iii) The valves then return to pattern number 1 "run". The pressure request number supplied by the logic system 93 to the DAC 95 continues to be varied so as to maintain the correct time of flight. However, the logic system 93 does not re-enter the top-up mode before the expiry of a period of 7 to 20 minutes, to allow time for mixing and to allow the lower viscosity ink to reach the ink gun 75. If the pressure request number still exceeds the threshold value at the end of this period, the top-up mode is normally re-entered. However, if the pressure request number has not been brought below the threshold value after 8 passes through the top-up mode, the logic system 93 automatically enters the shut down mode.

The preset volume of solvent added in each "top-up" routine is preferably not more than 10%, more preferably about 2%, of the normal maximum volume of ink in the printer, i.e. the volume of ink in the printer when the reservoir 31 is full to the maximum level 33. For a convenient reservoir size, this volume may be 1 to 1.5 liters, so that 25 cubic cm will be a suitable top-up solvent volume.

The effect on the ink viscosity of 25 cubic cm of solvent will vary depending on how much ink there is in the reservoir 31. It is preferred to add this relatively small amount of solvent in each "top-up" routine, and perform the routine as many times and as often as necessary, as this allows a closer control of the viscosity.

As described above, the top-up mode is entered in response to the pressure request number exceeding a threshold value. The pressure request value required to maintain the correct time of flight is an indirect measure of ink viscosity. As an alternative, the auto-modulation system, which will be described below, could be used as an indirect measure of ink viscosity. As the viscosity of the ink increases, the modulation voltage which must be applied to the piezoelectric crystal in the ink gun 75 to obtain good jet break-up also increases. Consequently, it would be possible to set a modulation voltage threshold, and if this threshold is exceeded by the correct modulation voltage as determined by the auto-modulation sequence, the top-up mode is entered.

CONDUIT

The conduit 5 carries fluid pipes and electrical connections between the main cabinet 1 of the printer and the print head 5. It carries three fluid lines: the ink supply line to the ink gun 75 from the feed valve 67; the return line from the ink gun 75 to the purge valve 69; and the gutter line from the gutter 77 to the gutter valve 71.

It carries a number of electrical lines, including the modulation voltage to the piezoelectric crystal of the ink gun 75, the charge voltage to the charge electrode of the print head 3, the EHT supply to the deflection electrodes of the print head 3, the sensor return line from the phase sensor 89 and time of flight sensor 91, and lines to and from a heat sensor and a Hall effect switch in the print head 3.

The fluid and electrical lines are encased in a flexible sheath. The sheath has a steel core to prevent RF emissions from the conductors from interfering with nearby devices. Preferably, the conduit 5 is about 3 m long.

The conduit 5 is permanently attached to the print head 3, but is detachable from the main cabinet 1. The electrical lines are brought to a parallel interface, which also includes hard wired connections between predetermined pins of the interface which indicate which type of print head, micro, midi or macro, is connected to the conduit 5. In this way, the logic system 93 is always able to determine directly from the pattern of connections made at the interface, which type of print head is currently connected.

PRINT HEAD

Figure 9:
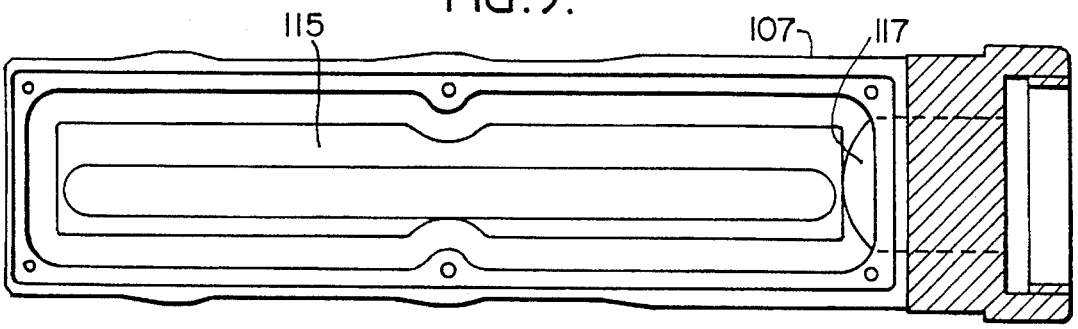
FIG. 9 is a plan view of the print head body of the embodiment of FIG. 1.
Figure 10:
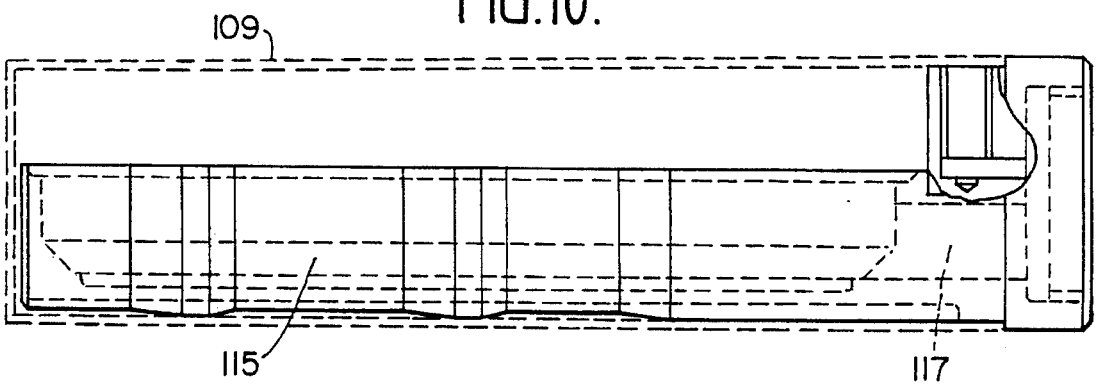
FIG. 10 is a side view of the print head body of the embodiment of FIG. 1.

The print head consists essentially of a print head body 107, a print head cover 109 and a mounting substrate 111 mounted on the print head body 107. FIGS. 9 and 10 show the print head body 107 before the mounting substrate 111 is fitted. The position in use of the print head cover 109 is shown in broken lines in FIG. 10. The print head cover 109 is essentially an aluminium cylinder, closed at one end, which fits around the print head body 107 to close off the operating components of the print head from the surrounding environment, and to protect them from impact.

Figure 11:
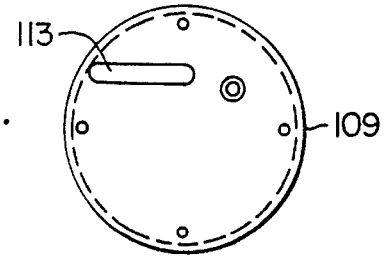
FIG. 11 is an end view of the print head cover of the embodiment of FIG. 1.

During operation of the printer, the ink droplets to be printed on articles passing the end of the print head pass through a slit aperture 113 in the end of the print head cover 109, as shown in FIG. 11.

The print head cover 109 is preferably made by pressing a spinning aluminium sheet against a cylindrical former, so as to form both the closed end surface and the cylindrical side surface from the aluminium sheet. This unitary construction avoids the difficulties and potential weakness of a welded joint between the end and the side of the print head cover 109.

As can be seen in FIGS. 9 and 10, the end portion of the print head body 107 which is joined to the conduit 5 is also generally cylindrical, but over most of its length the print head body 107 has a shape of a cylinder cut by a horizontal plane slightly above the cylindrical axis. In use, the print head mounting substrate 111 is fitted to this portion of the print head body 107, so that its top surface is flush with the top surface of the print head body 107.

The main portion of the print head body 107 is hollowed out, as shown at 115 in FIGS. 9 and 10. The hollow 115 is closed by the mounting substrate 111 when it is fitted to the print head body 107.

All the operating parts of the print head are fitted to the mounting substrate 111 and are arranged so that all electrical and fluid connections are made on the underside of the mounting substrate, with the connection lines running in the hollow 115. An aperture 117 through the cylindrical end portion of the print head body 107 opens into the hollow 115, and the fluid and electrical connection lines pass through the aperture 117 into the conduit 5.

During manufacture of the print head, after the mounting substrate 111 has been mounted on the body 107, and the print head has been tested, the hollow 115 is completely filled with a potting compound, which seals all the connections on the underside of the mounting substrate 111 from the environment, and also holds all the tubes and wires in position so as to minimise the likelihood that any of them will come disconnected in use.

Many substances are suitable for use as the potting compound. It may be rigid, e.g. a hard-setting resin. It may be elastomeric. A substance which does not require hot curing is preferred. If it is to contact electric signal or power conductors, it should be a good insulator. In most circumstances a silcone rubber will be suitable.

If it is necessary to clean the print head, cleaning solvent may be squirted or sprayed at the appropriate part of the mounting substrate 111, or the print head may be dipped as a whole in a bath of cleaning solvent. The cleaning solvent must be compatible with the ink, as some of it may enter the ink system through the gutter 77, and it is preferably the same as the ink solvent. Typical solvents are methyl ethyl ketone and ethanol (for inks used on food), but others such as water may be used, depending on the ink. The potting compound preferably is resistant to any cleaning solvent likely to be used.

Figure 12:
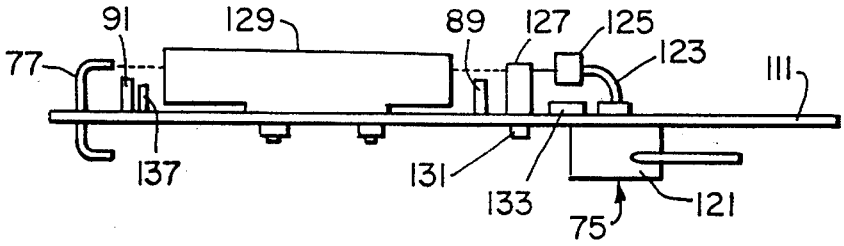
FIG. 12 is a side view of the mounting substrate for the macro-print head of the embodiment of FIG. 1.
Figure 13:
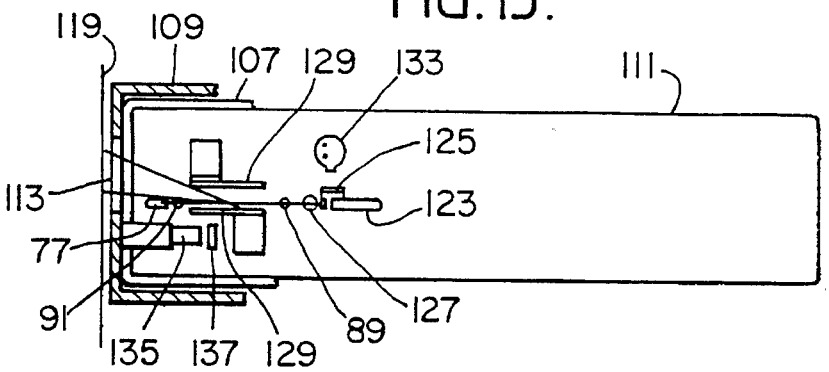
FIG. 13 is a plan view of the mounting substrate for the micro print head for the embodiment of FIG. 1.
Figure 14:
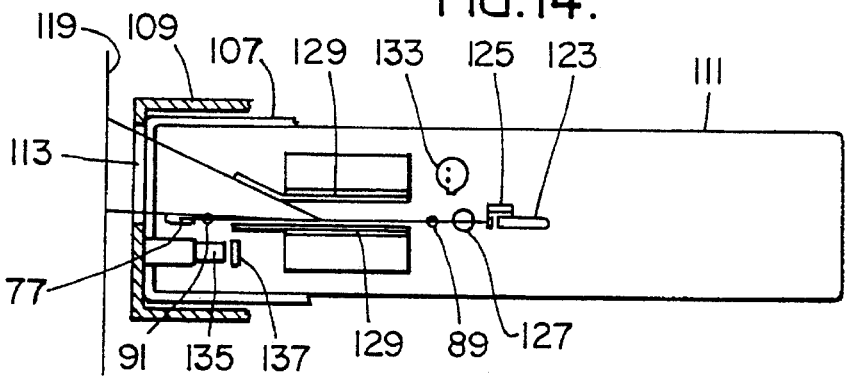
FIG. 14 is a plan view of the mounting substrate for the midi print head for the embodiment of FIG. 1.
Figure 15:
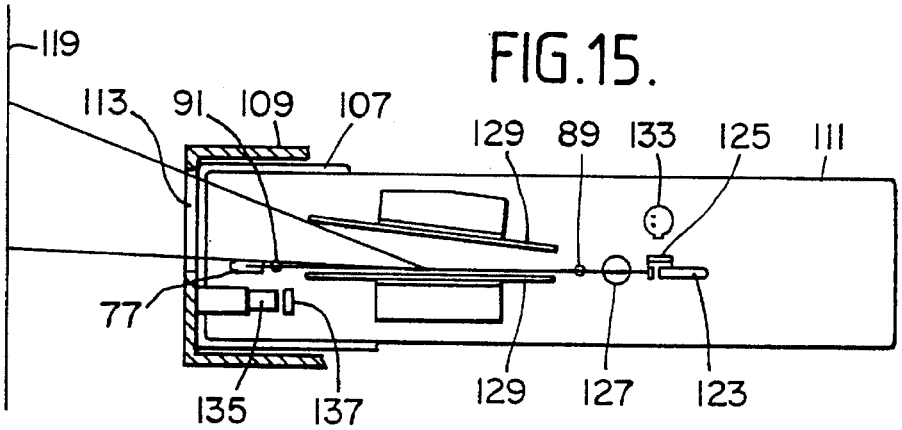
FIG. 15 is a plan view of the mounting substrate for the macro print head for the embodiment of FIG. 1.

FIG. 12 shows the print head mounting substrate for the macro print head from the side, and FIGS. 13, 14 and 15 are plan views of the mounting substrates for the micro, midi and macro print heads respectively. In FIGS. 13, 14 and 15 the end portions remote from the conduit of the print head body 107 and print head cover 109 are also shown, together with the surface 119 being printed onto. The electrical and fluid connections to the components mounted on the mounting substrate 111 are not shown in FIGS. 12 to 15.

The mounting substrate may, for example, be a circuit board or a sheet of a machinable ceramic.

Figure 16:
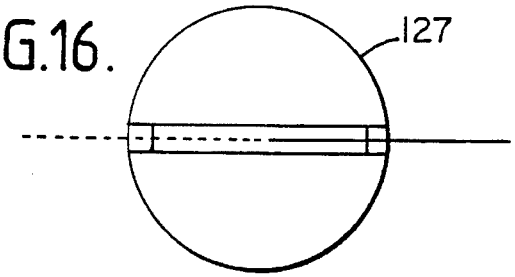
FIG. 16 is a plan view of a charge electrode for the embodiment of FIG. 1.

The main body 121 of the ink gun 75 is mounted on the underside of the mounting substrate 111. From the top of the ink gun body 121, an ink tube 123 extends upwardly and then horizontally. The ink tube 123 ends at a nozzle, which is held in place by a nozzle cap 125 screwed onto the end of the ink tube 123. In FIGS. 13 to 15, the nozzle cap 125 is shown partially cut away, so that the nozzle end of the ink tube 123 is visible. The ink jet travels from the nozzle of the ink gun 75 generally parallel to the mounting substrate 111. From the gun 75, the jet passes through a slot in the charge electrode 127. An enlarged plan view of the charge electrode 127 is shown in FIG. 16. The ink jet breaks into ink droplets while it is passing through the charge electrode 127. The ink droplets are charged in accordance with the voltage on the charge electrode 127, as will be explained below.

From the charge electrode 127, the ink droplets pass over the phase sensor 89, and then pass between the deflection plates 129. The deflection plates are connected to an EHT supply in the main cabinet 1 of the printer. Typically one will be at 1–5 kV above ground and the other will be at 1–5 kV below ground. For safety, two 30 megohm current limiting resistors are connected between each deflection plate 129 and the EHT supply, one in the conduit 5 and one in the main cabinet 1. Droplets which are not charged pass between the deflection plates undeflected, and pass over the time of flight sensor 91 and enter the gutter 77. FIGS. 13 to 15 show the path of undeflected droplets entering the gutter 77, the path of droplets having the minimum deflection necessary just to miss the gutter, and the path of droplets having the maximum deflection without striking the deflection plates 129.

The deflected droplets pass through the slit aperture 113 in the print head cover 109, to land on the surface 119 being printed onto.

An LED 131 is mounted on the underside of the mounting substrate 111, as shown in FIG. 12, directly underneath the charge electrode 127. When the LED 131 is on, the light emitted by it is visible through the central slit of the charge electrode 127. This provides back lighting of the point at which the ink jet breaks into droplets, which permits optical monitoring of the jet at the point of break-up. The LED 131 is illuminated in pulses synchronised with the modulation frequency of the piezoelectric crystal in the ink gun 75, so that a stroboscopic effect is obtained and the illuminated ink droplets appear to be stationery. Drop formation can then be observed using a magnifying eye glass or a high magnification TV camera.

A temperature sensor 133 is mounted on the mounting substrate 111. As a safety precaution, the ink jet printer shuts down automatically if the temperature sensor 133 output exceeds a threshold value. The solvents commonly used for ink let printing inks are flammable, so that if the area of the print head became hot or caught fire, the ink jet could provide further fuel for the fire. The possibility that the ink jet itself could catch fire is very remote, as the speed of the ink jet tends to be much faster than the light-back speed of the flame, so that any ink jet fire immediately blows out.

A magnet 135 is mounted on the end surface of the print head cover 109, and as can be seen in Figures 13, 14 and 15, when the print head cover 109 is in place, the magnet 135 is positioned immediately adjacent a Hall effect switch 137. Accordingly, the output of the Hall effect switch 137 provides a signal indicating the presence or absence of the print head cover 109. If the print head cover 109 is ever removed during operation of the printer, the EHT supply to the deflection plates 129 is automatically turned off for safety, the charging waveform is removed from the charge electrode 127, and the LED 131 is automatically turned on. In order to extend the life of the LED 131, it is not illuminated during the periods when it could not be visible because the print head cover 109 is in position. The ink jet continues to run, but only to the gutter 77.

DROPLET CHARGING AND DEFLECTION

As is shown most clearly in FIG. 16, the charge electrode 127 is divided into two parts with a gap between them, and the ink jet passes through this gap between the two parts of the charge electrode. The ink jet breaks up into droplets while it is in the gap of the charge electrode 127. A charge is induced on the droplets roughly in proportion to the voltage lo applied to the charging electrode 127. The maximum charging voltage will typically be anything up to about 300 volts. In the preferred embodiment, the charge electrode voltage varies between 0 volts and 255 volts.

The charged droplets are deflected by the field created by the deflection plates 129, in accordance with the amount of charge on each droplet. The potential on the deflection plates can be varied to vary the printed raster height for any given number of drops per raster line. The greater the potential, the greater the deflection field strength, and thus the greater the printed raster height. The deflection plates are typically charged each to about 1 to 5 kilovolts, one above ground potential and the other below ground potential. The voltage applied to the deflection plates 129 is limited by the need to avoid corona discharge from the plates and arcing between them.

Similar deflection plate potentials are used for the micro, midi and macro print heads. In order to provide the necessary deflection for the larger, heavier droplets, the midi and macro print heads have longer deflection plates, so that the droplets are in the field for longer. The deflection plates 129 are also shaped and angled in the midi and macro print heads to provide a strong field where the droplets enter it, yet avoid the droplets striking the plates when under maximum deflection.

In order to deflect different droplets by different amounts, the charge induced on the droplets is varied by varying the voltage applied to the charge electrode 127, while the deflection field between the deflection plates 129 remains constant.

As noted above, the ink jet breaks into droplets at a point within the gap in the charging electrode 127. The ink is electrically conductive, and the ink gun 75 and the ink system in the main cabinet 1 of the printer are both at earth potential. Accordingly, the portion of the ink jet between the ink gun 75 and the charge electrode 127 acts as an electrical conductor and the charge applied to the charge electrode 127 induces an opposing charge on the portion of the ink jet in the charge electrode gap. Because the point at which the ink jet breaks into droplets is within the charge electrode gap, the induced charge is maintained in the ink throughout the break-up process. Therefore, the induced charge is also present in the droplet after break up. Since the separated droplets are no longer electrically connected to earth, the charge induced on each droplet is trapped and continues to remain on the droplet even after it has left the area of the charge electrode 127.

In drop formation, instabilities in the ink jet cause it to form into areas of larger diameter connected by narrow ligaments. The areas of larger diameter continue to expand, forming the droplets, while the ligaments narrow and eventually break. The amount of charge trapped on a droplet will be the amount of charge induced on it by the charge electrode 127 at the moment when the ligament between it and the remainder of the ink jet breaks. The amount of this charge will be determined by the voltage on the charge electrode 127 at the instant when the ligament breaks, and also by the size of the gap in the charge electrode 127, the side-to-side position of the ink jet within the charge electrode gap, the permittivity of air and various other factors.

For ideal charging behaviour, the point of ink jet break-up should be half way along the charge electrode gap, and the spacing between the charge electrode 127 and the ink gun 75 is chosen so that this relationship will hold when the ideal modulation voltage is applied to the ink gun.

It is also necessary that the appropriate voltage to charge a droplet is maintained on the charge electrode 127 during a brief charging period and at the moment when the ligament between the droplet and the remainder of the ink jet breaks. The voltage on the charge electrode 127 must then be altered to the voltage required for charging the next droplet, and the new voltage must be maintained for the charging period and at the moment when the ligament between the next droplet and the ink jet breaks. Therefore, it is necessary to ensure that the correct phase relationship is maintained between the charge waveform applied to the charge electrode 127 and the droplet forming and break-up cycle. This will be described below under "Phasing".

CHARGE ELECTRODE WAVEFORM

During printing, uncharged droplets will pass to the gutter 77. The range of charges applied to droplets to be printed will depend on the height of the print raster, which is one of the features which can be selected when programming the legend to be printed. For example, the most deflected drop in the raster might require a charge on the charge electrode of 200 volts, while the least deflected drop might require a charge of about 70 volts. Thus, a droplet charged by a charge electrode voltage of 70 volts misses the gutter 77 and strikes the surface 119 being printed onto, but it passes very close to the gutter.

Figure 17:
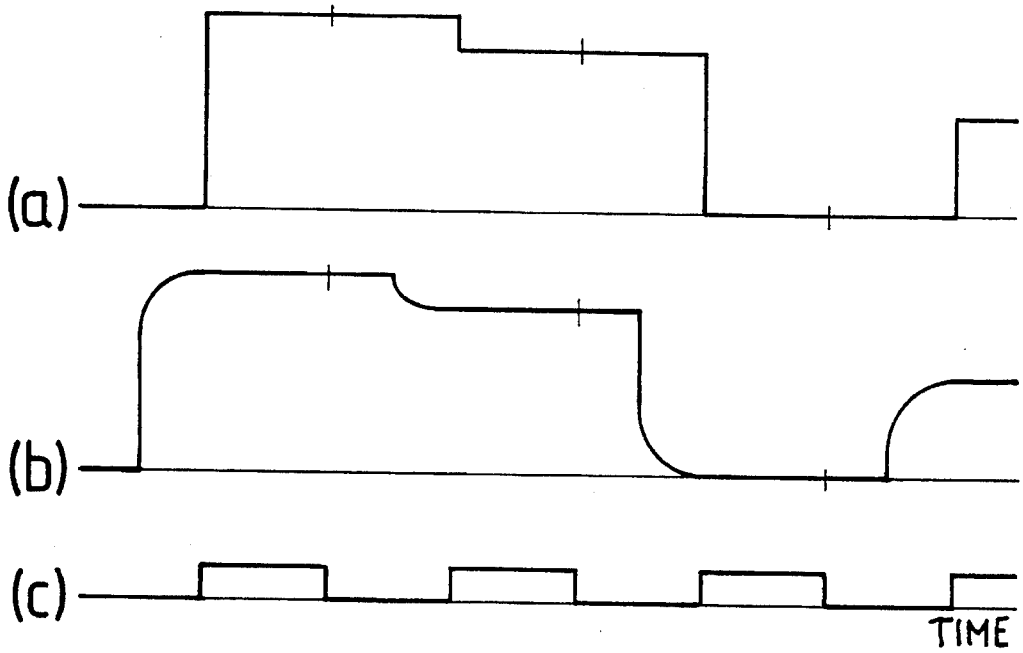
FIG. 17 is a view of charge electrode waveforms for the embodiment of FIG. 1.

The signal applied to the charge electrode 127 is, in effect, a pulse amplitude modulated signal, with a pulse width equal to the period of the droplets in the ink jet. Waveform (a) of FIG. 17 shows an idealised example of the charging waveform. In this example, an uncharged droplet is to be followed by one having a moderate level of charge, then by one having a slightly lower level of charge, then by another uncharged droplet, and then by one having a low level of charge. The voltage applied to the charging electrode 127 rises and falls accordingly.

For each line of the raster, successive droplets are associated with successive dot positions on the raster line. Each droplet is either charged to the appropriate level to deflect it to the correct dot position, if the dot is to be printed, or is not charged and passes to the gutter 77 if no dot is to be printed at the corresponding position of the raster line. Therefore, each line in a raster seven dots high will take a minimum of seven drop periods to print.

Provided that the maximum relative speed between the print head 3 and the surface 119 being printed onto is not exceeded, the surface 119 will move only slightly during the time taken to print one raster line, and the lines of dots will be substantially transverse to the direction of movement. Preferably, each raster line is followed by at least one uncharged droplet. This helps to reduce the electrostatic effect on each other of the last droplet of one raster line and the first droplet of the next. If the surface 119 is moving at the maximum permitted speed, it will be time to begin printing the next line of the raster immediately after the first uncharged droplet, and so there will be only a single uncharged droplet between successive raster lines. However, if the surface 119 is moving more slowly, further time must be allowed for the correct printing position to be aligned with the print head 3 before the next raster line is printed. In order to accommodate slowly moving surfaces, the printer can wait for up to one thousand raster line periods between printing each line.

The period of each charging pulse in the pulse amplitude waveform supplied to the charge electrode 127, as illustrated in FIG. 17(*a*), is equal to the period of the ink jet break-up and droplet formation cycle. This cycle has an ideal frequency dependant on the ink gun nozzle diameter and the ink jet speed, as is well known. Typically, the frequency will be between 10 and 250 kHz, more typically between 15 and 150 kHz.

As noted previously, it is necessary to maintain the correct phase relationship between the charging waveform and the instants of separation of successive droplets from the ink jet. This will now be described.

PHASING

The ink jet breaks up into droplets under the influence of the modulation signal applied to the piezoelectric crystal of the ink gun 75. The ink droplets will be formed at the same frequency as the frequency of the modulation signal, and at least over a short period the moment of break-up will occur at a particular phase position of the modulation signal. Accordingly, the logic system 93 can use the modulation signal to time the charging waveform, and the phasing operation is carried out to maintain the correct phase relationship between the charging waveform applied to the charge electrode 127 and the modulation signal applied to the piezoelectric crystal of the ink gun 75.

During the phasing operation, ink droplets continue to be formed in the normal way but the signal applied to a charge electrode 127 is altered.

It is possible to put a small charge on a droplet, e.g. with a charging voltage of 10 to 20 volts, such that the deflection of the droplet is so little that it still enters the gutter 77. This low level of the charge and voltage will be referred to as the phasing charge and the phasing voltage.

During phasing, pulses at the phasing voltage are applied to the charge electrode 127, but these phasing pulses each last for only half the normal charge pulse period, and are separated by zero voltage intervals also of half the normal pulse period. Thus, the phasing waveform applied to the charge electrode 127 is a square wave having a period equal to the drop period. The phasing waveform is shown in FIG. 17(*c*).

The phase position of the square wave voltage applied to the charge electrode 127 relative to the modulation signal is then varied, for example in steps of 1/16 of a modulation signal period. At each phase position, a burst phasing waveform is applied to the charge electrode 127 after an interval during which no voltage is applied to the charge electrode.

If break-up of the ink jet occurs during the half of each drop period when the phasing voltage is applied, then the droplets will be charged. In this case, the burst of phasing waveform will result in a packet of charge passing the phase sensor 89, leading to an output signal, e.g. a pulse of about 2 mV, from the phase sensor. However, if break-up occurs during the zero voltage portions of the phasing signal between the half width phase voltage pulses, no charge will be trapped on the droplets, and so the burst of phasing waveform will not result in an output from the phase sensor 89. The burst of phasing waveform is preferably from 5 to 30 pulses long, more preferably from 8 to 15 pulses long.

The output from the phase sensor 89 is input to the wave shaping circuit 105 (see FIG. 8), which comprises a comparator as already noted. The threshold value for the comparator is chosen such that it is exceeded, and an output is provided to the logic system 93, by the output of the phase sensor 89 when the phasing charge is present on the droplets passing over the phase sensor 89.

The phase relationship between the modulation signal and the phasing waveform is varied until a transition between a phase sensor 89 output exceeding a threshold value and a phase sensor 89 output below the threshold value indicates that the trailing edge of the phase pulses occur substantially at the moment of break-up. With this phase relationship between the signal applied to the charge electrode 127 and the modulation signal, the instant of jet break-up is half way through each pulse period of the charge electrode signal. (It will be appreciated by those skilled in the art that the leading edge of the phase pulses could be used in place of the trailing edge).

Figure 18:
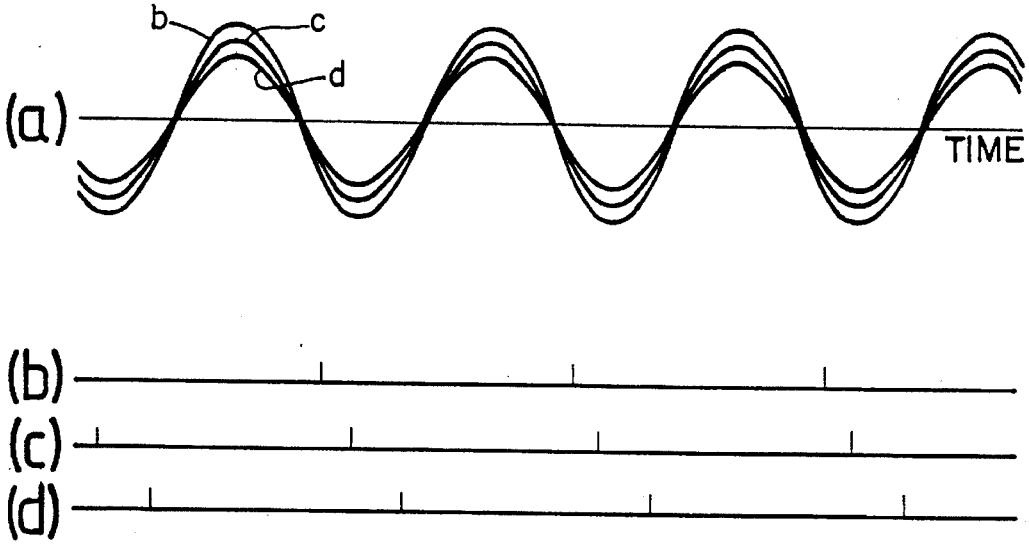
FIG. 18 is a view of modulation signal waveforms and jet break-up instants for the embodiment of FIG. 1.

This situation is illustrated in FIGS. 17 and 18. Waveform (a) of FIG. 18 shows the modulation signal applied to the piezoelectric crystal of the ink gun 75 (the signal is shown at three different amplitudes for reasons which will be discussed later). Waveforms (b), (c) and (d) of FIG. 18 show moments of jet break-up (droplet separation). FIG. 18 shares a common time axis with FIG. 17. If it is assumed that the moments of jet break-up are as shown in FIG. 18(*b*), the phasing waveform of FIG. 17(*c*) has the desired phase relationship.

The idealised charging waveform of FIG. 17(*a*) is in phase with the phasing waveform of FIG. 17(*c*), so that the instants of droplet separation occur midway through each charging pulse. If the waveform of the voltage on the charge electrode 127 truly followed the idealised waveform of FIG. 17(*a*), this would be the best phase position for it.

However owing to capacitive effects, the voltage on the charge electrode 127 has a finite rise and fall time, so that the period of correct charge onto charge electrode 127 lags slightly behind the applied voltage. The actual voltage waveform on the charge electrode 127 resembles FIG. 17(*b*). In order to compensate for this, and to ensure that the instant of break-up always occurs near the center of the time when the correct voltage is present on the charge electrode 127, the pulse amplitude modulated signal applied to the charge electrode 127 is advanced by (e.g.) a quarter of a signal period relative to the theoretically correct position determined by means of the half width phasing pulses, as shown in FIG. 17(*b*).

For convenience, the instants of break-up are also marked on waveforms (a) and (b) of FIG. 17.

The phasing operation is carried out repeatedly when the printer is running, in between the times when printing is taking place. In this way, the printer adjusts the phase position of the charging signal to compensate for variations in the instant of break-up due to changes in temperature of the ink and other factors. It is a high priority task, and is normally carried out every few seconds whenever printing is not taking place (e.g. once every 2 to 5 seconds).

TIME OF FLIGHT MEASUREMENT

To measure ink jet time of flight following completion of the phasing operation, either the phasing waveform is maintained but is shifted by a quarter of a signal period, or the charge electrode waveform is returned to full width pulses all at the phasing voltage, so as to ensure that the ink droplets are charged with the phasing charge. A batch of 8 to 15 droplets at a time is charged following a period during which the droplets are not charged. The batch of charged droplets will first pass over the phase sensor 89, and then over the time of flight sensor 91. It will produce a pulse output from each of the sensors 89, 91. The outputs from the two sensors 89, 91 are wired together, and are applied to a comparator and wave shaper 105 (FIG. 8). As has been mentioned above with reference to FIG. 8, these pulses are applied to the logic system 93 which determines therefrom the time of flight, i.e. the time taken by a droplet to travel the distance between the phase sensor 89 and the time of flight sensor 91. If this period is within 1 per cent of the target value, it is considered to be correct. If the measured time of flight differs by more than 1 per cent from the target value, the logic system 93 alters the pressure request signal sent to the DAC 95.

The phase sensor 89 and the time of flight sensor 91 are each constructed as two coaxial conductors, insulated from each other, the outer conductor being grounded while the inner conductor provides the output signal.

Time of flight may not necessarily be measured every time phasing is carried out, but conveniently every fourth or fifth time.

AUTO-MODULATION

The ink jet leaving the nozzle of the ink gun 75 is induced to break into droplets by the effect of a vibrating piezoelectric crystal in the ink gun body 121. The piezoelectric crystal is induced to vibrate by a modulation signal applied to it. As already mentioned, the ideal frequency of modulation is determined by the nozzle diameter of the ink gun, so as to provide one droplet every 4.51 ink jet diameters. This is well known. Useful drop formation in practice can normally be obtained if the droplet wavelength to jet diameter ratio is from 3 to 7.

However, good droplet formation is also affected by the amplitude of the modulation signal, and the auto-modulation routine maintains this amplitude at an optimum level.

Figure 19:
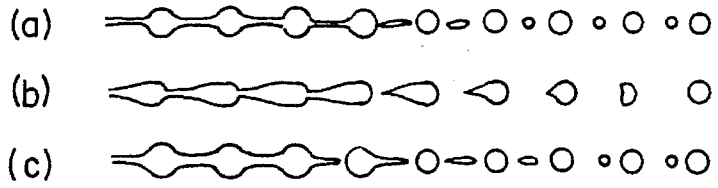
FIG. 19 is a view illustrating the break-up of an ink jet into ink droplets.

If the ink jet is over-modulated or under-modulated (too high or too low a modulation voltage), the ink jet does not break cleanly into evenly spaced identical droplets, but instead smaller satellite droplets are formed in between the normal droplets. FIG. 19 illustrates jet break-up for an under-modulated jet, a correctly modulated jet, and an over-modulated jet at (a), (b) and (c) respectively. The satellite droplets tend to have a different charge to mass ratio, and therefore are deflected differently by the deflection field, and they also tend to have a different velocity from the main droplets.

In addition to the formation of satellite droplets, varying the modulation voltage also changes the length of the ink jet before break-up, and it is possible to use measures of the break-up length to determine the correct modulation voltage. Briefly, over a range of modulation voltages representing correct break-up, the break-up length (i.e. the length from the jet nozzle to the point of break-up) is at a relatively constant minimum level. The break-up length increases as the modulation voltage moves to under-modulation and as it moves into over-modulation.

Figure 20:
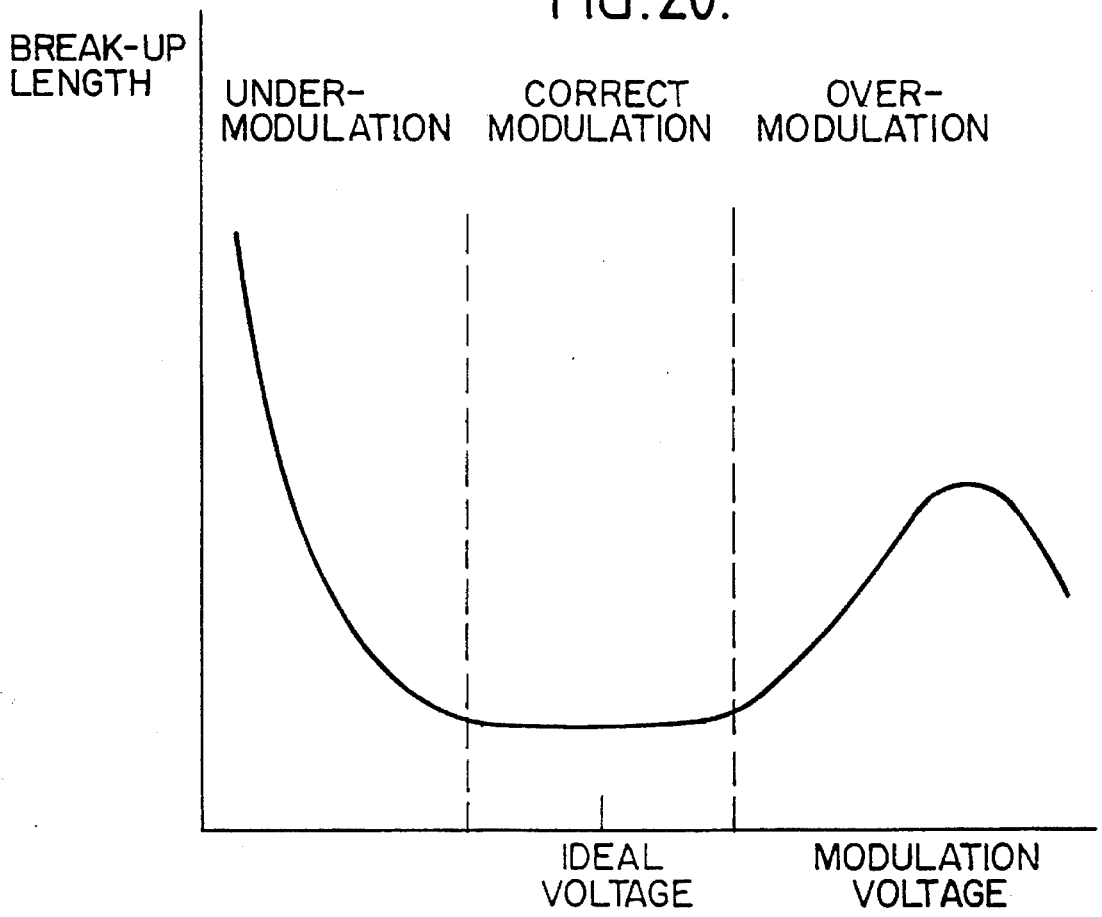
FIG. 20 is a graph of jet break-up length against modulation voltage.

FIG. 20 shows the approximate shape of a plot of break-up length against modulation voltage. The regions of under-modulation, correct modulation and over-modulation are marked. The ideal voltage is in the middle of the correct modulation range.

A problem arises because the precise shape of this plot, and the voltages at the boundaries between the regions, varies from crystal to crystal, and also varies with modulation frequency, ink viscosity, and other factors. Therefore, a factory preset modulation voltage may not be ideal for any given print head, and even if it gives correct modulation initially it may not continue to do so at all times during use of a print head.

In the prior art, it is usually a duty of the operator to inspect jet break-up with an eyeglass when starting up the printer, and to adjust the modulation voltage until a satellite free break-up is obtained. However, this is not easy, and the operator may select a modulation voltage which does not provide the best possible performance. Furthermore, the operator may not bother to perform this operation at all. Therefore, in the preferred embodiment of the present invention, the modulation voltage is set automatically.

If the jet velocity remains constant (which can be assured by use of the time-of-flight control), a change in jet break-up length will cause a corresponding change in the moment of break-up. To be more precise, a change in break-up length will cause a change in the phase position, relative to the modulation signal, of the instants of successive drop separations. This is illustrated in FIG. 18.

In FIG. 18(*a*), three different modulation voltages (i.e. peak-to-peak amplitudes) are shown. It is assumed that these cause three different jet break-up lengths, and so three different jet breakup phase positions are shown in FIG. 18(*b*), (*c*) and (*d*), each for the correspondingly lettered amplitude in FIG. 18(*a*).

It is not, in general, possible to measure the total jet break-up length from the break-up phase position, but a change in the phase position will correspond directly to a change in break-up length. Accordingly, it is possible to record the manner in which break-up phase varies as the modulation voltage is varied, and identify from the co-variation the modulation voltage for a characteristic portion of the curve. A suitable modulation voltage can then be determined using the modulation voltage at the characteristic point. For instance, once this modulation voltage has been identified, the voltage can be varied by an amount known (from the shape of the curve) to result in a voltage in the correct modulation region and probably close to the ideal voltage. The amount may, for instance, be an offset or a factor.

There are many alternative ways of performing this process. It is presently preferred to measure the break-up phase position by the phasing routine described above. The auto-modulation process is preferably carried out as follows.

Initially a modulation voltage of 20 volts or less, which is known to be in the under-modulation range is applied. The phasing operation is then carried out and the correct phase of the charge electrode signal is stored. The time of flight measurement is used to maintain the ink jet at a correct viscosity and velocity. The modulation voltage is then incremented and the phasing operation repeated.

Initially, the EHT supply to the deflection plates 129 is removed. This avoids over-deflection of satellite drops (which have a larger charge/mass ratio) so as to miss the gutter 77. Towards the end of the auto-modulation procedure, when there is no danger of satellite drops, the EHT supply is restored slowly over 3 to 4 seconds, so that the print head 3 is ready to print. The EHT supply is not restored instantaneously as this could cause localised dielectric breakdown, and also the capacitive current drawn might trip the safety cut-out in the EHT supply circuit.

As the modulation voltage is incremented, with the phasing operation being carried out after each increment, the correct phase for the charging signal will vary in a direction corresponding to decreasing jet break-up length. As the correct modulation range is entered, a large change in modulating voltage causes only a very small change in correct charge signal phase. As the modulation voltage enters the over-modulation range, increments in the modulation voltage will again cause a change in the correct phase of the charging signal, but the required phase change will be in the opposite direction as the break-up length is now beginning to increase again.

Accordingly, it is possible to detect the point at which the direction of change in the correct phase reverses for continuing incrementation of the modulating voltage. This is a characteristic point on the modulation curve, near the boundary between correct modulation and over-modulation. When this point is detected, the modulation voltage is decreased by a preset amount.

The curve for jet break-up length against modulation voltage can be determined experimentally for a representative sample of ink guns, and the preset amount can then be selected to ensure that it brings the modulation voltage to a point near the centre of the correct modulation voltage range. The preset amount may be an offset or a factor, or it may be defined in some other way such as the amount of modulation change which results in a preset phase offset.

The correct modulation voltage range is approximately 80 volts to 150 volts for the macro print head, approximately 60 volts to 100 volts for the midi print head, and approximately 20 volts to 60 volts for the micro print head. The ideal modulation voltages are approximately 110 volts, 80 volts and 40 volts for the macro, midi and micro print heads respectively. These values are the peak-to-peak voltages for a sine wave modulation signal. Therefore, the preset amount may be an offset of 40 volts for the macro print head and 20 volts for the midi and micro print heads.

It will be appreciated that other methods of automatic modulation control are possible. For instance, a different characteristic point on the modulation curve could be detected, such as the point at which the amount of change of the correct charging signal phase with an increment of modulation voltage falls below a minimum threshold variation. The modulation voltage could be decremented from a value in the over-modulation range instead of incremented from a value in the under-modulation range.

If the preset amount corresponds to a preset phase offset, then following the identification of a characteristic point, the modulation voltage may be incremented or decremented, as the case may be. The phasing operation would then be carried out again. The cycle of increment or decrement modulation voltage and then conduct phasing would be repeated until the phase position of the jet break-up instant had altered by the required amount.

If variation from gun to gun is such that it is difficult to select from a single characteristic point an appropriate amount by which to change the modulation voltage, two or more characteristic points may be identified. This will tend to be slower, but more accurate. Change in direction of phase shift, or increase in amount of phase shift to exceed a low threshold, may be used to identify two characteristic points one at each side of the correct modulation region. The modulation voltage may then be determined or a voltage between, e.g. mid-way between, the voltages at the two characteristic points.

The use of the phasing operation to determine changes in break-up phase, and thus changes in break-up length, is advantageous. It is a sensitive and accurate indicator of changes in break-up length. Since the phasing operation normally has to be carried out anyway, to ensure correct droplet charging, it can provide a means of measuring changes in break-up length without adding greatly to the complexity of the printer.

It is preferred to carry out auto-modulation relatively frequently, for example once every 2 to 10 minutes, for an initial warm-up and settling period after starting the printer. The correct modulation changes relatively fast during this period, as, for example, the ink temperature rises as the printer and other nearby machinery comes into operation. Once the operating conditions have stabilised, auto-modulation need only be carried out less frequently, typically once every 30 minutes to 2 hours, unless the printer is in a rapidly varying environment.

INK GUN CONSTRUCTION

Figure 21:
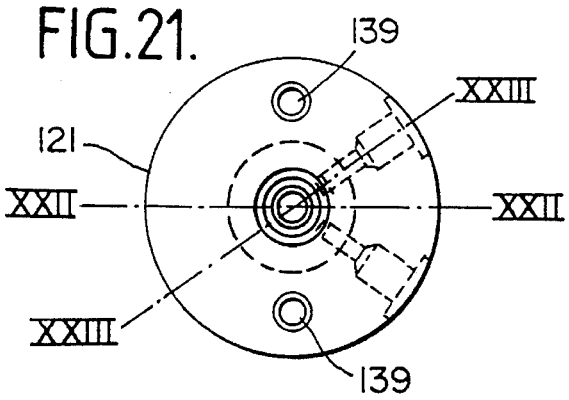
FIG. 21 is a plan view of the ink gun body of the embodiment of FIG. 1.
Figure 22:
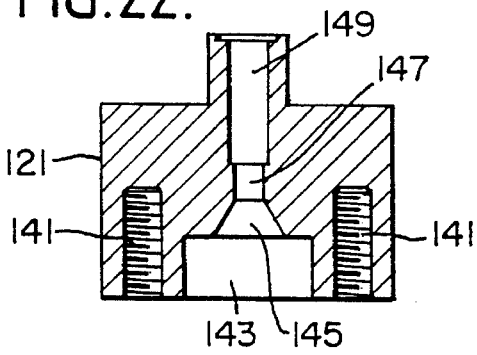
FIG. 22 is a section on line XXII—XXII through the ink gun body of FIG. 21.
Figure 23:
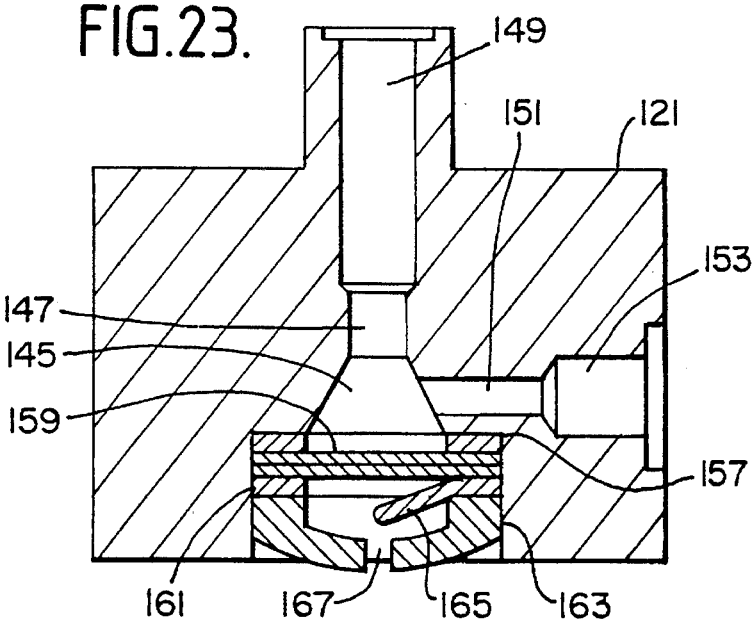
FIG. 23 is a section along line XXIII—XXIII through the ink gun body of FIG. 21.

FIG. 21 is a top plan view of the ink gun body 121. FIG. 22 is a view of a section taken along line XXII—XXII in FIG. 21. FIG. 23 is an enlarged sectional view taken along a line XXIII—XXIII in FIG. 21, showing the mounting arrangement for the piezoelectric crystal.

The ink gun body 121 is a steel block. Two screw-threaded holes 131 in the top surface of the ink gun body 121 are used to mount it on the mounting substrate 111. Two further screw-threaded holes 141 in its lower surface enable a cover plate to be attached, holding the piezoelectric crystal assembly in place.

A cylindrical recess 143 is formed in the bottom surface of the ink gun body 121, to contain the piezoelectric crystal assembly. A frusto-conical ink cavity 145 opens into the cylindrical recess 143. The top end of the ink cavity 145 merges into an exit passage 147. The ink cavity 145 and the ink passage 147 have the same diameter at the point where they meet. This diameter is also the same as the internal diameter of the ink tube 123. The ink passage 147 opens into a slightly wider cylindrical passage 149, which emerges through the top of the ink gun body 121. The wider passage 149 receives the end of the ink tube 123, so that ink can flow from the ink cavity 145 into the ink passage 147 and then into the ink tube 123 without encountering any transverse surfaces. This reduces the reflection back to the crystal of pressure waves caused by the crystal movement.

Two horizontal passages 151, spaced about 90 degrees apart, extend from the side of the ink gun body 121 into the ink cavity 145. The horizontal passages 151 each have widened end portions 153 into which metal tubes 155 may be fitted. The metal tubes 155 are connected in use through the conduit 5 to the feed valve 67 and the purge valve 69 respectively. Thus, the metal tubes 155 and horizontal passages 151 provide the ink supply and purge lines for the ink cavity 145.

Figure 24:
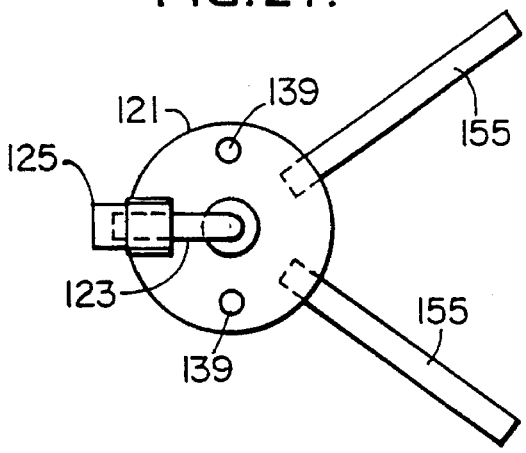
FIG. 24 is a plan view of the ink gun of the embodiment of FIG. 1.
Figure 25:
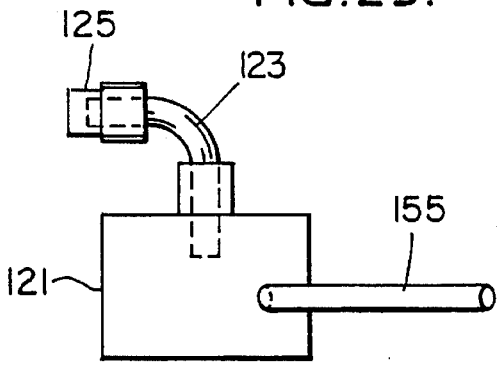
FIG. 25 is a side view of the ink gun of the embodiment of FIG. 1.

FIGS. 24 and 25 show the ink gun 75 in top plan view and side view, with the ink tube 123 and the metal tubes 155 fitted to the ink gun body 121.

The piezoelectric crystal assembly is shown in FIG. 23. At the top end of the cylindrical recess 143, closest to the ink cavity 145, there is a polymeric washer 157, preferably of PTFE. Next below the PTFE washer 157 is the piezoelectric crystal 159. The PTFE washer 157 forms an ink-tight seal between the crystal 159 and the ink gun body 121.

As is indicated in FIG. 23, the crystal 159 is a bimorph piezoelectric crystal. Its upper surface is earthed through the conductive ink. Its lower surface is in contact with a metal washer 161, preferably of copper.

Finally, a domed end cap 163 is in contact with the lower side of the copper washer 161. A holding plate (not shown) is screwed to the underside of the ink gun body 121, using the screw holes 141. The plate presses against the domed end cap 163. This pressure holds the components of the piezoelectric crystal assembly together.

As can be seen in FIG. 23, the end cap 163 protrudes slightly below the ink gun body 121. The holding plate has a corresponding recess, providing an increased area of contact. The screw members which screw into the screw holes 141, and secure the holding plate, are tightened to a preset torque. This ensures that the correct pressure is applied to the end cap. Too great a pressure could cause damage to the piezoelectric crystal 159.

The copper washer 161 has a tag 165 which extends radially inwardly and also is angled away from the piezoelectric crystal 159. A central aperture 167 in the end cap 163 allows a wire carrying the modulation signal to pass through the end cap and be soldered to the end of the tag 165. The holding plate has a corresponding aperture.

It should be noted that none of the other components of the piezoelectric crystal assembly contact the crystal 159 except at a narrow region around its circumference. Therefore, the crystal 159 is free to flex substantially unhindered.

It has been found that if the wire carrying the modulation signal is solderd directly to the lower surface of the crystal 159, the stiffness of the wire and the inertial mass of the solder attached to the crystal significantly hinder the flexing of the crystal and reduce the efficiency of the ink gun.

Additionally, it should be noted that the ink seal provided by the PTFE washer 157 is provided at the point where the crystal 159 is clamped. Accordingly, the crystal is not attempting to move at the point of the ink seal when the crystal flexes.

In an earlier known arrangement, a disk shaped piezoelectric crystal is clamped on a circular line spaced significantly inwardly from its circumference, while a resilient seal is made between the circumference and the ink gun body. The earlier design has been shown to be less efficient than the gun of the preferred embodiment, and it is believed that this arises in part because the piezoelectric crystal is clamped at a different diameter from the position of the ink seal. Accordingly, during flexing of the crystal the portion of the crystal in contact with the ink seal will attempt to move, and this will be resisted by the seal. This resistance is believed to cause a significant loss of efficiency.

Hitherto, it has always been believed that it was essential for an ink gun to operate at a resonant frequency, in order to provide sufficient modulation energy to the ink (see, for example, U.S. Pat. No. 3,683,396).

In one known design of ink gun, a piezoelectric rod is arranged along the axis of an ink cavity. The rod is clamped at a point determined to be a node when the crystal is vibrating at its resonant frequency. The ink nozzle is formed in the end of the ink cavity and the distance between the nozzle and the end surface of the piezoelectric crystal is chosen so that the ink will resonate in that length at the resonant frequency of the crystal. The crystal is not a bimorph, and its vibrations do not alter the ink cavity volume, but instead it sets up a standing wave in the ink with a maximum at the ink nozzle.

Another known design uses a bimorph crystal to vary the volume of an ink cavity, and therefore bears a greater resemblance to the preferred embodiment of the present invention. However, the ink cavity is again arranged to resonate over the distance between the crystal and the nozzle, which is a straight distance as no curved ink tube is used. The gun is operated at the resonant frequency of the nozzle-to-crystal distance.

These resonant ink guns are reasonably efficient provided that the modulation signal is applied at the resonant frequency. However, a typical resonant gun has a very narrow band of operation. The resonant frequency will typically be chosen to be somewhere between 50 and 100 kHz, and the band of operation will typically be plus or minus 0.5 kHz around the resonant frequency. As has previously been mentioned, the best frequency of modulation for jet break-up into droplets varies with the nozzle diameter. Accordingly, a gun arranged to operate at a resonant frequency can only be used with a single nozzle diameter.

By contrast, the ink gun 75 of the presently illustrated embodiment is arranged to be highly efficient at non-resonant frequencies, and is intended to be used with non-resonant modulation frequencies. Consequently, the gun can be used with many different modulation frequencies, and the only difference between the guns used in the macro, midi and micro print heads is the diameter of the nozzle fitted to the end of the ink tube 123. This provides a significant advantage in ease of manufacturing and reduction in inventories over the prior art arrangement in which the provision of three different nozzle diameters required three completely different ink gun constructions.

The reasons for the very high efficiency of the illustrated ink gun are not fully understood. The features that the ink-tight seal and the electrical connection to the modulation signal are provided at the clamping location, so that the necessary contacts with the crystal do not hinder its flexing, are believed to significantly enhance the efficiency of the gun, as noted above. Additionally, the bimorph crystal 159 diameter and thickness are relevant, as is the diameter and cone angle of the ink cavity 145.

In theory, the greater the crystal diameter and the less its thickness, the more efficient will be the ink gun. This is because increased thickness of the crystal tends to make it stiffer and flex less, while increased diameter increases the overall distance of flexing movement. However, the wider and thinner the crystal is, the weaker it is, and consequently the more likely it is to break during flexing movement. Suitable crystal dimensions have been found to be 4 to 10 mm diameter and 0.4 to 1 mm total thickness of the bimorph. Preferred values are 5 mm diameter and 0.6 mm total thickness.

The ink cavity 145 preferably has a diameter at the point where it opens into the cylindrical recess 143 equal to the exposed diameter of the crystal 159. That is to say, the cylindrical recess 143 should be wider than the maximum diameter of the ink cavity 145 by the width needed to accommodate the PTFE washer 157.

It is believed that the best shape for the ink cavity 145 may be that of an acoustic horn, rather than a cone. An acoustic horn shape would give the best theoretical amplification in the ink of the movement of the crystal 159. However, the curved shape of an acoustic horn is difficult to manufacture and so a straight-sided conical shape is preferred. If a straight-sided conical shape is used, the full included cone angle should preferably be at least 50 degrees. The angle is preferably not more than 70 degrees. The most preferred range of angles is 55 to 65 degrees. It has been determined experimentally that best performance is obtained if the full included cone angle is approximately 60 degrees. It may be noted that this cone angle also provides a reasonable straight line approximation to the acoustic horn curve.

The illustrated ink gun has been tested with various lengths of ink tube 123, between 15 and 21 mm (the total ink path length is 4 mm greater than these ink tube lengths). It was found that the tube length affected the frequencies of resonance in the ink gun, and also the efficiencies of the ink gun at the resonant frequencies, but neither the length of the ink tube 123 nor the presence of a curve in it appeared to affect significantly the high efficiency of the gun at non-resonant frequencies.

The ability to use the ink gun 75 with an ink tube 123 is advantageous, as it allows the ink gun nozzle to be spaced from the ink gun body 121. This facilitates mounting of the ink gun 75 in the print head 3. The distance from the top of the ink cavity along the ink tube to the nozzle will depend on the mechanical design of the gun. Preferably, it is at least 5 mm, more preferably at least 10 mm, still more preferably at least 15 mm. About 20 mm will probably be convenient in many cases, and distances up to 25 mm are most preferred. In most cases, the distance should be less than 40 mm, and preferably not more than 30 mm.

The illustrated ink gun has been tested at modulation frequencies of up to 150 kHz, and with peak-to-peak modulation voltages of 5 to 270 volts. It was found to be highly efficient under these conditions. As noted above, even for the large nozzle macro print head, correct modulation is typically achieved with voltages of less than 150 volts.

As noted above, the ability of the ink gun of the preferred embodiment to work at non-resonant frequencies is advantageous because it permits the same gun construction to be used at various different modulation frequencies and consequently with various different nozzle diameters. Additionally, it is preferable to work off resonance if the gun has sufficient efficiency, because these portions of the modulation frequency against efficiency curve are relatively flat. Accordingly, if the curve varies for any reason, for example due to changes in temperature, ink viscocity or any other reason, the efficiency of the ink gun is not substantially altered.

Attempts to use known prior art ink guns, designed to operate at resonant frequencies, at non-resonant frequencies are unlikely to succeed, as very large modulation voltages would have to be applied and the piezoelectric crystal might crack or deform in unpredictable ways.

PRINT HEAD CALIBRATION

None of the print head components mounted on the mounting substrate 111 can be moved or adjusted by an operator of the ink jet printer. This is in marked contrast to most prior art printers, in which the operator typically is able to move some components, and typically has to adjust the modulation voltage, and other print head parameters, before each print run.

During manufacture of the print head 3, the components mounted on the mounting substrate 111 are aligned and adjusted using Jigs, and are secured in the position giving the best print quality. If it is desired to clean the nozzle of the ink gun 75 with a solvent bath, no parts are moved or detached from the mounting substrate, but instead the print head body 107 and the mounting substrate 111 are immersed as a whole in the solvent bath. The potting compound in the hollow 115 of the print head body seals and protects all the connections to the mounting substrate 111 from the solvent bath. The print head components may also be cleaned by spraying or squirting solvent at them.

In addition to the physical adjustments during manufacture referred to above, each print head is test-operated with ink controlled to have a chosen calibration viscosity within the operating range of the ink gun 75, and the operating parameters of the print head are varied to determine the values which provide the best print quality. These values are recorded, to provide for each print head an individual calibration code.

Conveniently, the calibration viscosity is the same as the chosen preferred viscosity for operation of the printer. However, it is possible to calibrate with one viscosity and operate at another, by applying a correction to the values of the operating parameters. This also allows the printer to operate with various different ink viscosities if the correction values are supplied to it.

The calibration code in the preferred embodiment is a 14 digit number. The first digit specifies the print head type, micro, midi or macro. The next five digits specify the target time of flight value referred to above. The next four digits are a charge calibration code. The next three digits specify the target pressure request number as described above. The final digit is a check sum. The use of the charge calibration code is described below under "Charge Error Correction". If the ink viscosity is at a preset level, then the target time-of-flight (as specified by the calibration code) will be achieved with the ink pressure provided by the target pressure request number (as specified by the calibration code). Preferably, the preset viscosity level is the same as at least one of the calibration viscosity level and the preferred operating level.

When a new print head 3 is fitted to the main cabinet 1 of a printer, the calibration code specific to the new print head should be entered using the keyboard 29. The calibration code values are then used by the logic system 93 to maintain ideal printing conditions for particular print head fitted.

As mentioned above, the electrical terminal in the conduit 5 which plugs into the main cabinet 1 of the printer includes pins tied together in a pattern which indicates to the logic system 93 the type of the print head connected. If the print head 3 is disconnected and another (or the same) print head is reconnected, and the calibration code for the reconnected print head is not entered through the keyboard 29, the logic system can determine from the pin connections on the conduit 5 which type of print head is connected and defaults for the calibration code for each print head type are stored in the logic system 93.

In this way, the logic system 93 is enabled to provide reasonable printing conditions for the print head 3 even if the calibration code is not entered. However, print quality is likely to be better if the calibration code is entered, enabling the logic system 93 to adapt the printer operation to the precise requirements of the print head 3.

It will be appreciated that the calibration code could be provided to the logic system by other means rather than through the keyboard 29. For instance, the code could be recorded electronically in the print head of the conduit 5, so that the logic system can read the code out whenever a new print head is connected. Equally, the calibration code could be recorded as a bar code and entered into the logic system 93 using a light pen.

The default values for the time of flight, stored in the logic system 93, are selected to be equivalent to ink jet velocities in the range 10 to 25 meters per second. The precise value is selected in accordance with nozzle diameter (and also having regard to the modulation frequency and the Rayleigh criterion linking droplet wavelength to jet diameter) as will be clear to those skilled in the art. The default pressure calibration numbers are equivalent to pressure request numbers of 196 for the micro and midi print heads and 75 for the macro print head, as already mentioned under "Valve and Pump Control". The default value for the charge calibration code is given below under "Charge Error Correction".

Modulation voltage and charge electrode signal phase are not specified by the calibration code, as they are automatically adjusted to the optimum value during operation of the printer, as described above.

CHARGE ERROR CORRECTION

Figure 26:
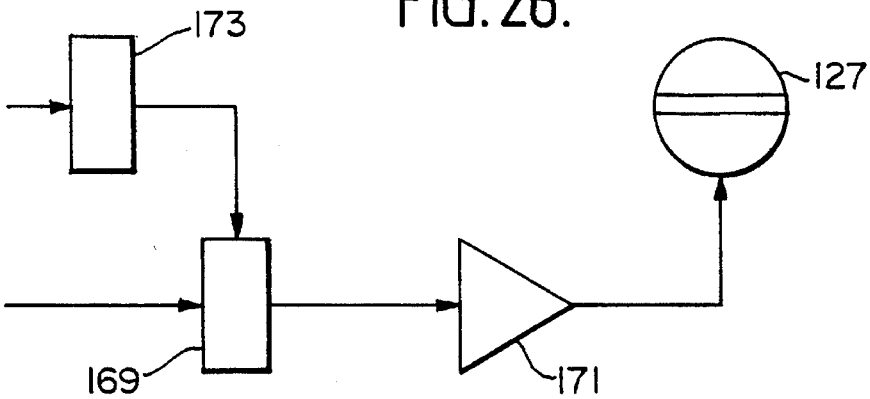
FIG. 26 is a diagrammatic view of the driving circuit for the charge electrode of the embodiment of FIG. 1.

In order to obtain the correct degree of deflection of any particular ink droplet, the droplet must be charged to the correct level. The manner in which the ink droplets are charged by the effect of the voltage applied to the charge electrode has been described above. The logic system 93 controls the voltage applied to the charge electrode, so as to charge each ink droplet to the required amount, through the circuit illustrated in FIG. 26.

The logic system 93 outputs a charge number to a multiplying digital-to-analogue converter 169, where it is converted to an analogue value. The analogue value is supplied to a high gain charge electrode amplifier 171, and the amplified analogue signal is applied to the charge electrode 127.

For correct operation, a given charge number supplied to the multiplying DAC 169 should always result in the same level of charge induced on the ink droplet. In order to ensure that this occurs, it is necessary to compensate for two sources of variation in the ink droplet charging system.

First, owing to inherent errors in the multiplying DAC 169 and the amplifier 171, especially the latter, the same charge number may result in slightly different voltages being applied to the charge electrode 127 in different printers. This variation will be called "error 1".

Second, the amount of charge induced on an ink droplet by any given voltage on the charge electrode 127 depends on the degree of capacitive coupling between the ink jet and the charge electrode 127. This in turn varies with the position of the ink jet within the gap in the charge electrode 127. Briefly, if the ink jet passes through the gap in the charge electrode 127 off centre, so that it is closer to one side of the charge electrode than to the other, there will tend to be improved coupling, and a greater charge induced for a given charging voltage, as compared with an ink jet which passes exactly down the centre of the gap in the charge electrode 127. This source of variation will be referred to as "error 2".

During manufacture of the printer, the magnitude of error 1 is determined by attaching a voltmeter to the charge electrode while instructing the logic system 93 to output one or more known charge numbers. Since the multiplying DAC 169 and the charge electrode amplifier 171 are contained in the main cabinet 1 of the printer, the magnitude of error 1 remains fixed so far as the logic system 93 is concerned. Accordingly, the value of error 1 as determined in the manner just described is stored in non-volatile memory in the logic system 93.

The magnitude of error 2 will be a characteristic of each individual print head 3. The position of the ink jet in the gap of the charge electrode 127 will depend on the precise alignment of the components of the print head. When each print head is tested and calibrated during manufacture, the path of the ink jet through the charge electrode 127 is only adjusted if this is necessary to obtain satisfactory print quality. Otherwise, no attempt is made to ensure that the ink jet passes through the charge electrode gap precisely centrally. Instead, during the calibration operation the magnitude of error 2 is determined, for example by determining precisely the voltage which must be applied to the charge electrode 127 to obtain any particular degree of deflection of the ink droplets. The magnitude of error 2 is a feature of each individual print head, and so it must be supplied to the logic system 93 as part of the print head calibration code. The charge code number referred to above conveys this information.

The default value for the charge code number is 1000 for all three print heads. This is equivalent an ink jet position mid-way between the sides of the gap in the charge electrode 127.

The logic system 93 uses the value of error 1 from its non-volatile memory, and the value of error 2 supplied from the calibration code, to determine an overall error code. This error code is supplied to an error digital-to-analogue converter 173, and the corresponding analogue output is applied as an analogue multiplying signal to the multiplying DAC 169. In this way, the voltage actually supplied to the charge electrode 127 is compensated for errors 1 and 2.

CHARGE ELECTRODE CONTROL

In order to generate a pattern to be printed, such as a letter of the alphabet, the logic system 93 must have stored information identifying which dots in each raster scan of the print sequence are to be printed, and the corresponding charge numbers to be output to the charge electrode 127. This is complicated by the fact that the path followed by a given droplet of the ink jet is affected by other nearby droplets due to electrostatic repulsion of like charges. Additionally, the flight path of a previous droplet has an aerodynamic effect on a following droplet. The magnitudes of both of these effects vary with the extent to which each ink droplet is charged and deflected. Accordingly, the amount of charge which should be induced on an ink droplet in order to deflect it by the required amount will vary depending on whether the other droplets near it in the ink jet are also charged or not. This can be understood by considering FIG. 27, which shows the dot pattern required to print the letter "B".

Figure 27:
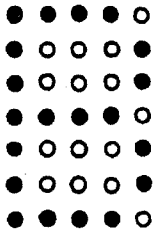
FIG. 27 is a representation of the pattern of dots used to print the letter "B"

In FIG. 27 the vertical direction is a direction of deflection of the ink droplets, and the horizontal direction is a direction of relative movement between the print head 3 and the surface 119 being printed onto. In this example, each line of the raster comprises 7 dots.

It can be seen that the fourth dot of the raster is printed both for the first line and for the second line, but in the first line the fourth dot is preceded and followed by other dots which are printed, whereas in the second line the fourth dot is preceded and followed by dot positions which are not printed. Accordingly, the ink droplets which will be deflected to print the fourth dots in the first and second raster lines will be in different electrostatic and aerodynamic environments, one being preceded and followed by charged and deflected droplets and the other being preceded and followed by uncharged and deflected droplets. Because of this difference in electrostatic environments, the two droplets must be charged by different amounts in order that they are deflected to the same position.

Furthermore, at the moment an ink droplet separates from the ink jet, it will be close to the preceding droplets which have just separated. Any charge on these preceding droplets will affect the charge induced on the droplet about to separate, so that the charge trapped on a droplet is not necessarily the charge apparently specified by the voltage on the charging electrode 127. Therefore, the voltage applied to the charge electrode 127 should be varied to compensate for this effect as well. This compensation is needed for droplets intended for the gutter 77 as well as those intended to form printed dots.

For this reason, it is not possible simply to store every character to be printed as a pattern of dots, and then generate the charge electrode voltages on the basis that a dot to be printed with a particular deflection requires a particular charge electrode voltage. It is possible to store every character to be printed as a sequence of charge electrode voltages, each voltage being determined in advance in accordance with the electrostatic and aerodynamic environment of each ink droplet to be printed. However, this requires a greatly increased memory capacity in the logic system 93, since each dot in a simple dot pattern requires one bit of storage whereas each dot requires eight bits of storage if the electrode voltages are to be stored with the resolution of 256 levels. At the same time, the system is inflexible, and the entire drop voltage sequence has to be worked out in advance and stored for every character to be printed.

Figure 28:
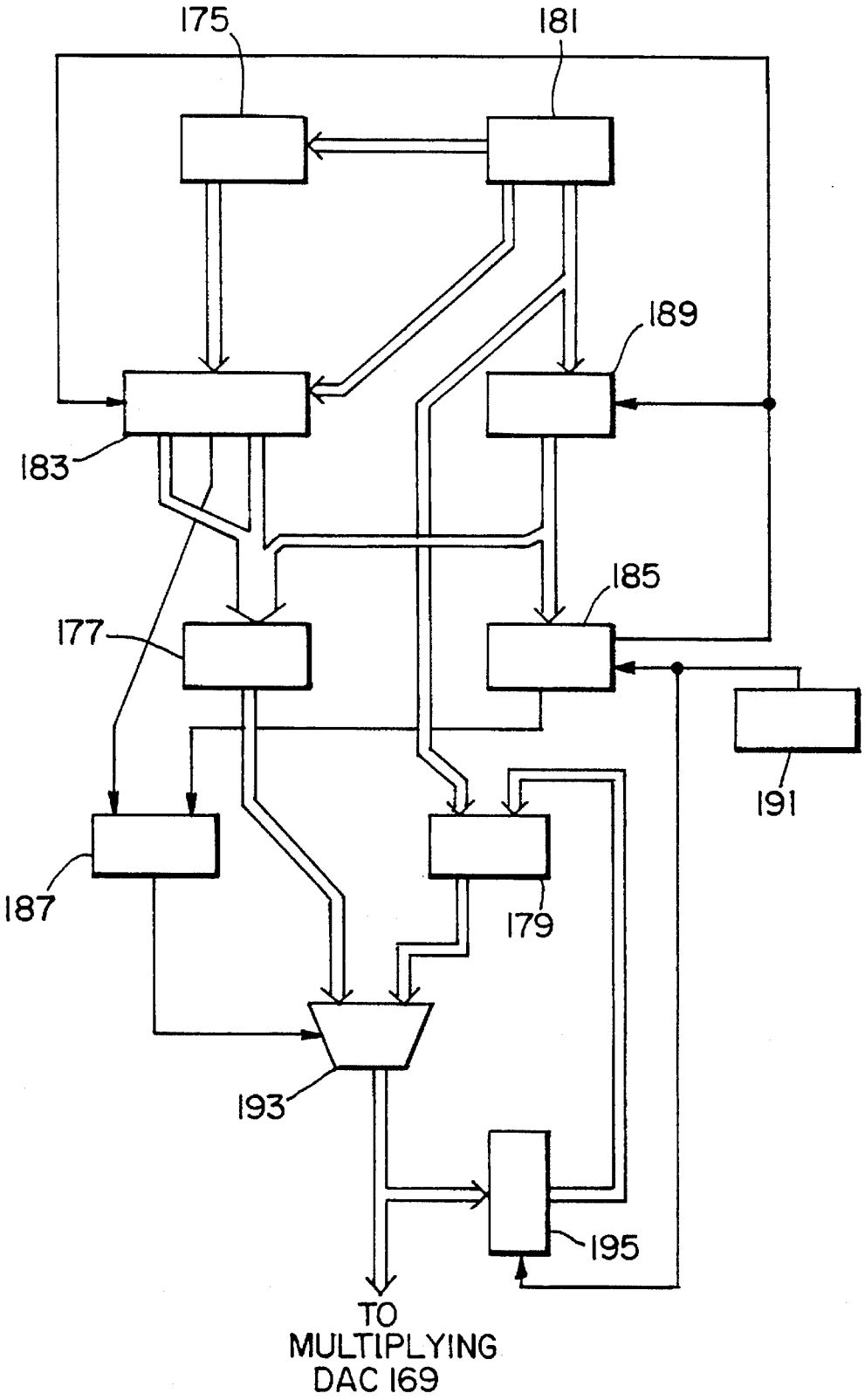
FIG. 28 is a diagrammatic view of the charge level control system for the charge electrode of the embodiment of FIG. 1.

FIG. 28 illustrates a portion of logic system 93, which is used to generate the charge number output to the multiplying DAC 169. All patterns to be printed are stored as simple dot patterns in a character store 175. The voltage level required on the charge electrode 127 in order to deflect an ink droplet to a particular dot position in the raster is stored in a charge level store 177. The charge level store 177 is divided into sections, one for each number of dots per raster line which is available with the printer. For example, one part of the charge level store 177 stores voltage levels required when there are five dots per raster line, another stores voltage levels required when there are seven dots per raster line and so on. Within each section, the charge level store 177 stores the voltage level to be applied to the charge electrode 127 for each dot position in the raster. Several different charge levels are stored for each dot position, in accordance with which of certain predetermined nearby droplets are charged or uncharged. A historic correction store 179 stores the voltage level required on the charge electrode 127 to induce no charge on an ink droplet, compensating for the effect of the charge induced on the preceding droplet.

The arrangement of FIG. 28 works as follows. A charge level processor 181 receives signals from other components (not shown), which supply it with "print go" information, the message to be printed, etc., in a manner which will be familiar to those skilled in the art. The charge level processor 181 outputs an address to the character store 175 specifying which raster line of which character is to be printed next. In response to this address, the character store 175 outputs the particular dot pattern required for the specified raster line to a serialiser and multiplexer 183.

A clock signal from a sequencer 185 provides a pulse for each ink droplet which corresponds to a dot position of the raster line. Under the control of this clock signal, the serialiser and multiplexer 183 steps through the dot positions in the raster line input to it, and outputs a serial signal, indicating whether a dot is to be printed in the current dot position, to a gate 187. The charge level processor 181 outputs a significiant drop combination signal to the serialiser and multiplexer 183. This specifies which particular combination of other nearby droplets is considered to determine the voltage level which needs to be applied to the charge electrode 127 to deflect an ink droplet to print in a particular dot position. Thus, the drop combination signal might specify that the five immediately preceding drops and the three immediately following drops are considered to be significant, or alternatively the six immediately preceding and the two immediately following, or the four immediately preceding and the four immediately following, and so on. Simultaneously with outputting the value (print or no print) of the current drop position to the gate 187, the serialiser and multiplexer 183 outputs in parallel the print values of the significant nearby drops as defined by the drop combination signal received from the charge level processor 181.

The print values of the significant drop combination form part of an address input to the charge level store 177. The values stored in the charge level store 177 must be appropriate for the particular drop combination specified as significant by the charge level processor 181. However, it will be seen that the present system provides flexibility in that if it is decided that better correction is provided by taking account of a different combination of nearby droplets, the charge level store 177 can simply be exchanged for a replacement store bearing information determined in accordance with the new drop combination, and the drop combination signal output from the charge level processor 181 is altered accordingly.

The charge level processor 181 also outputs a signal indicating which section of the charge level store 177 is to be used (i.e. how many drops there are per line of the raster in the current printer setting). This signal takes the form of the remainder of the address to the charge level store 177, and is output to a counter 189 and to the historic correction store 179. The counter 189 also receives the clock signal from the sequencer 185, and increments for each dot position of the raster which has been printed. Accordingly, the output of the counter 189 specifies both the required section of the charge level store 177 and the dot position within that section. This is provided to the charge level store 177 as the remainder of its address.

The counter 189 output is also input to the sequencer 185. Accordingly, the sequencer is provided with information specifying both the number of drops per raster line and the current dot position within the raster line. The sequencer uses this information to determine whether the next droplet to break from the ink jet is to be treated as equivalent to a printed dot position or whether it is to be a guard droplet. It is known to reduce the electrostatic and aerodynamic effects on each other of the droplets equivalent to raster dot positions by inserting between them one or more droplets called guard droplets, which are not equivalent to raster dot positions and always pass to the gutter 77. Generally speaking, the need for guard droplets increases both with the number of droplets per raster line and with closeness to the more deflected end of the raster line, since the charge to be induced on each droplet increases with these factors. The pattern of guard droplets to be provided for each number of dots per raster line is stored in the sequencer 185, and it determines, in accordance with the input it receives from the counter 189, whether or not a guard droplet is now required to be inserted before the next droplet equivalent to a raster line dot position.

The sequencer 185 receives a signal from a droplet clock 191, which outputs a clock pulse for each droplet which separates from the ink jet. The droplet clock 191 is synchronised with the modulation signal applied to the piezoelectric crystal 159, and its phase position relative to the modulation signal is determined by the phasing operation described above. For each pulse from the droplet clock 191, the sequencer 185 either outputs a signal indicating a guard drop to the gate 187, or it outputs a clock signal to the serialiser and multiplexer 183 and the counter 189. In this way, the clock inputs received by the serialiser and multiplexer 183 and the counter 189 indicate only steps through raster line dot positions, and they do not advance to the next dot position when a guard droplet is specified instead of a dot position droplet.

The use of the sequencer 185 means that the pattern of guard droplets used is entirely independent from the contents of the character store 175 and the charge level store 177, and is independent of the operation of all the other components in the system.

Accordingly, the guard drop pattern can be stored in a ROM or the like within the sequencer 185, and if a different guard drop pattern is required the ROM can simply be replaced without the need to alter any other part of the circuit.

The charge level store 177 always outputs the stored voltage level addressed by its input, and this is provided as a first data input to a multiplexer 193. This value will be the correct value to be output as the charge number to the multiplying DAC 169 if the next droplet is equivalent to a raster line dot position and a dot is to be printed in that position. The output of the historic correction store 179 provides a second data input to the multiplexer 193. This will be the correct charge number to be supplied to the multiplying DAC 169 if the next ink droplet is either a guard droplet or a droplet equivalent to a raster line dot position at which no dot is to be printed. The output of the multiplexer 193 is switched between its two inputs by a control signal output from the gate 187. If the input to the gate 187 from the serialiser and multiplexer 183 indicates that no dot is to be printed at the present dot position, or if the input to the gate 187 from the sequencer 185 indicates that the next droplet is to be a guard droplet, the gate 187 output controls the multiplexer to output the input received from the historic correction store 179. Otherwise, the gate 187 controls the multiplexer 193 to output the input received from the charge level store 177.

The output from the multiplexer 193 is also input to a latch 195, in addition to being output as the charge number to the multiplying DAC 169. The latch 195 is clocked by the droplet clock 191, and its output provides part of the address input to the historic correction store 179. Thus, in respect to any droplet, the address input to the historic correction store 179 is the voltage level applied to the immediately preceding droplet, supplied by the latch 195, and the number of drops per raster line, supplied by the charge level processor 181.

When a droplet is about to break from the ink jet, the charge on the nearby preceding droplets will tend to induce an opposite polarity charge on the droplet just breaking off. In order to compensate for this, the voltage applied to the charge electrode 127 must be greater than would otherwise be required. Accordingly, the voltage level output by the multiplexer 193 reflects both the charge to be induced on the current droplet, and the charge induced on the previous droplet, and preferably to a lesser extent the charge induced on the drop before that, and so on, as determined by the significant drop combination set by the charge level processor 181. Accordingly, the input from the latch 195 to the historic correction store 179 reflects not only the charge on the immediately preceding drop, but also the charge on the drop before that, etc. In this way, the historic drop store 179 can use the voltage level required for the immediately preceding drop as its address input, and yet provide historic correction which takes account of droplets before the immediately preceding droplet.

The manner in which the historic correction store 179 works will be seen by considering a string of droplets intended for the gutter 77 which follow a highly charged droplet. For the first uncharged droplet, the address provided to the historic correction store 179 from the latch 195 will be the voltage level required to charge the highly charged preceding droplet. In order to overcome the reverse polarity charge which will be induced on the current droplet, a significant voltage must also be output to the charge electrode 127 for the first uncharged droplet. For the second uncharged droplet, the address input to the historic correction store 179 from the latch 195 will be the voltage level output for the first uncharged droplet. In response to this, significant, voltage level the historic correction store 179 will output another, lower, voltage level. Thus, the charge number output to the multiplying DAC 169 will decay over a number of droplet periods.

For every uncharged droplet apart from the first, no compensation is needed in view of the immediately preceding droplet, since the immediately preceding droplet is not charged. However, the highly charged droplet which precedes the first uncharged droplet will affect not only the droplet immediately behind, but the droplet behind tat and so on, although to a lesser extent. Thus, it can be seen that for a series of uncharged droplets the successive outputs from the historic correction store 179 decay as the nearest charged droplet becomes more remote and has less effect.

It has been found that adequate historic correction is provided if the output of the historic correction store 179 equals the input divided by a constant factor. Thus, the historic correction store 179 can be implemented by a divide-by-n circuit, in which the value of n determines the degree of historic correction. Alternatively, the historic correction store 179 can take the form of a conventional ROM or other store. However, the appropriate constant factor is typically different for different numbers of droplets per raster line. For this reason, the historic correction store 179 also receives an input from the charge level processor 181, specifying the current number of droplets per raster line. The value of n, or the section of the ROM used, is selected in accordance with this input. It will also be appreciated that the amount or pattern of historic correction provided can be changed by replacing or altering the historic correction store 179 without affecting the operation of the rest of the system.

Each of the character store 175, the charge level store 177, the guard drop pattern store of the sequencer 185 and the historic correction store 179 may be ROMs, which can be unplugged and replaced in a simple operation. The illustrated system provides great flexibility. New character dot patterns can be provided merely by replacing the character store ROM. New voltage levels for the charge electrode 127 and a new significant nearby droplet combination may be provided simply by replacing the charge level store 177 and instructing the charge level processor 181 to change the drop combination signal. The guard drop pattern can be changed simply by replacing the guard drop pattern ROM in the sequencer 185. The historic correction values can be changed simply by replacing the historic correction store 179. Each of these changes may be made simply by replacing one plug-in component, and making minor software alterations. No rewiring or replacement of the remainder of the system is required.

REMOTE SERVICING

The logic system 93 is programmed so that it can be interrogated and will provide information about the internal state of the printer. In one alternative, this can be done through the keyboard 29. As another alternative, the logic system 93 is connected to a telephone line through a modem, and can be interrogated from a remote terminal. Most preferably, the logic system 93 will respond to interrogation signals from both the keyboard 29 and a remote terminal connected via a modem. This facility is available both during normal operation and when the printer is not operating correctly and, for example, has shut down automatically.

The data provided in response to such interrogations is unlikely to be meaningful to the operator. However, it can be very valuable to a service engineer or other expert in determining why a particular printer is not providing good print quality or repeatedly shuts down automatically. When such performance problems are encountered with a printer, the operator can telephone the service engineer, and the service engineer can ask the operator over the telephone to interrogate the logic system 93 and relay the answers back to the service engineer. Alternatively, the operator can connect the logic system 93 to a telephone line through a modem and the service engineer can interrogate it directly.

Using the information gained by this process, the service engineer can begin to diagnose the likely causes of malfunction or poor operation, and can suggest to the operator certain remedial steps which might cure the problem. The steps may be well within the ability of the operator to carry out. For instance the service engineer may request the operator to replace the main filter 59 with a new one, or may ask the operator to connect a fresh solvent bottle 17.

The Applicants estimate that over fifty per cent of all service calls can be solved by problem diagnosis over the telephone in this manner and asking the operator to carry out simple remedial steps. This is highly advantageous.

From the operator's point of view, because he is able to solve the problem immediately under telephone guidance from a service engineer, the printer is restored to operation very quickly, whereas if the service engineer had to attend in person then the printer would be out of operation for at least the time it took for the service engineer to arrive.

From the service provider's point of view, this system allows servicing to be provided more effectively and at reduced cost, as a smaller proportion of the service engineer's time is spent travelling rather than carrying out service operations, and a smaller service vehicle fleet will be required.

This remote servicing facility is particularly useful if there is a source of expert advice hundreds or thousands of kilometers from the printer location, possibly in another country or even another continent. Because the internal operating conditions of the printer can be made available to the expert over a long distance telephone line, a problem may be solved in minutes, whereas it would have taken days and cost vastly more if the expert had had to travel to the printer location.

Even where it is not possible to carry out the entire service operation remotely, significant advantages are achieved if remote fault diagnosis is possible. In particular, the service engineer can then ensure that he has spares of all parts implicated as potentially faulty by the remote diagnosis before leaving the service depot to travel to the machine location. In this way, there is a much greater likelihood that the service engineer will be able to remedy the fault in the printer on his first visit.

Thus, there is a reduction in the number of times on which a service engineer will visit a malfunctioning printer, diagnose the fault, but have to make a second visit to correct the fault because the necessary spare part was not available on the first visit. This benefits both the user, by reducing the period for which the printer is out of service, and the service provider, by allowing more efficient use of service engineer's time.

In the preferred embodiment, the logic system 93 can be interrogated so as to provide the following information.

- The voltages available to the print head control circuitry within the logic system 93.
- The total time that the machine has been in use.
- The total time that the ink jet has been present and the machine has been in run mode.
- The hours of ink jet run time remaining until replacement of the main filter 59 is due.
- The hours of ink jet running remaining until the next periodic service check-up is due.
- The current phase of the signal to the charge electrode 127 relative to the modulation signal, and the direction in which this phase relationship is changing.
- The current magnitude of the off-set applied to the charging signal phase following a phasing operation, to compensate for the finite rise and fall time of the voltage on the charge electrode 127.
- The time of flight target value.
- The actual time of flight value as measured using the phase sensor 89 and the time of flight sensor 91.
- The current voltage of the modulation signal applied to the piezoelectric crystal 159.
- The target pressure request number.
- The pressure request number currently being supplied to the DAC 95.
- The measured pressure number provided by the ADC 103.
- The pressure request number at which a "solvent add" routine is initiated.

The information relating to ink pressure and time of flight is particularly useful. From the pressure request number currently being supplied to the DAC 95 (or the measured pressure number from the ADC 103) together with the measured time of flight value, it is possible to calculate the ink viscosity. If the viscosity is very low, then it appears that the machine has been performing unnecessary solvent add routines. Conversely, if the viscosity is very high this suggests that the operator has ignored the warning display panel 25 and has failed to replace an empty solvent bottle 17.

If the pressure request number provided to the DAC 95 is significantly higher than the measured pressure value received from the ADC 103, this suggests that the feed-back loop 101 has driven the pump 97 to its maximum output, yet it is still unable to provide the pressure requested by the logic system 93. The most likely reason is a blockage in the main filter 59, which can be cured by replacing the filter with a fresh one. Alternatively, if the total time the machine has been running is very great, it is possible that wear in the pump 57 has significantly reduced its efficiency and a new pump is required.

With experience, service personnel will come to recognise the characteristic pattern of information provided for various common fault conditions.

Information about other internal operating parameters could be made available. For instance, if the printer included a viscosity meter, a direct measure of ink viscosity could be provided. Generally speaking, if two of ink pressure, ink viscosity and time of flight (jet speed) are known, the third can be calculated.

Although the present invention has been described particularly with reference to one presently preferred embodiment, it is not limited thereto, and various modifications and alternatives will be apparent to those skilled in the art. In particular, although the invention has been described with reference to a deflect-to-print type printer, it can be applied to a non-deflect-to-print type. The printer of the present invention can be used with conductive liquids which are not necessarily coloured, for purposes other than forming a visible pattern on a substance, and the term "ink" should be construed broadly accordingly.

APPENDIX A

Valve Patterns and Sequences

Valve 67 (Feed Valve) is either open or closed. When open it permits high pressure ink to flow from the pressure transducer 63 to the ink gun 75.

Valve 69 (Purge Valve) is a three way valve, permanently connected to the return line from the ink gun 75. It connects the ink gun either to valve 71 or to the ink reservoir 31.

Valve 71 (Gutter Valve) is a three way valve, permanently connected to a low pressure inlet to the suction device 65. It connects the low pressure from suction device 65 either to the gutter 77 or to valve 69 and thus to the ink gun 75.

Valve 73 (Top-up Valve) is either open or closed. When open it connects the solvent bottle 17 to a low pressure inlet to the suction device 65.

The valve patterns used are:

| Valve No. | Pattern Name | State of Feed Valve 67 | State of Purge Valve 69 | State of Gutter Valve 71 | State of Top-up Valve 73 |
|---|---|---|---|---|---|
| 0 | Stand-By | Closed | Valve 71 | Gutter | Closed |
| 1 | Run | Open | Valve 71 | Gutter | Closed |
| 2 | Purge | Open | Reservoir | Gutter | Closed |
| 3 | Nozzle Suction | Closed | Valve 71 | Valve 69 | Closed |
| 4 | Top-Up | Open | Valve 71 | Gutter | Open |

In state 0 "Stand-By", all the valves are de-energised.

In valve state 1 "Run" only feed valve 67 is energised. During this state, the power supplied to feed valve 67 is reduced, so as to reduce the heating effect it has on ink flowing through it. This is possible because the power required to maintain feed valve 67 in the open state is less than the power required to move it into the open state from the closed state. The other valves have no significant heating effect as they are all energised only briefly and for than a small proportion of the total time.

In valve state 0 "Stand-By", if the pump 57 is running ink will circulate from the ink reservoir 31 through pre-filter 55, pump 57, main filter 59, pressure transducer 63, suction device 65, and back to the ink reservoir. Some ink will circulate in this path whenever the pump is running. In this state, purge valve 69 connects the ink gun to valve 71, but valve 71 connects the suction device 65 to the gutter 77 and leaves the purge valve 69 disconnected. Thus, in this state both the ink supply line to the gun 75 and the return line from the gun 75 are closed, while suction pressure is applied to the gutter 77, and the solvent bottle 17 is isolated.

In valve state 1 "Run", the feed valve 67 is open and high pressure ink is delivered to the ink gun 75. Accordingly, an ink jet will be provided from the nozzle of the ink gun 75. The other valves remain in their stand-by states, so that the return line from the ink gun 75 remains closed, the solvent bottle 17 remains isolated, and suction pressure is applied to the gutter through gutter valve 71 to remove ink from the ink jet entering the gutter and return it to the ink reservoir 31.

In valve state 2 "Purge", the feed valve 67 remains open, and an ink jet continues to be provided, but purge valve 69 connects the return line from the ink gun 75 to the ink reservoir 31. In this state the ink gun 75 can be purged of air which may have accumulated in it while the ink jet printer was turned off.

In valve state 3 "Nozzle Suction", feed valve 67 is closed so that no ink is supplied to the ink gun 75. Purge valve 69 connects the return line from the ink gun 75 to valve 71, and valve 71 connects valve 69 to a low pressure inlet of the suction device 65. In this state, suction is applied to the return line from the ink gun 75 via valves 71 and 69, while valve 67 prevents fresh ink from entering the ink gun 75. Accordingly, the suction pressure of suction device 65 tends to apply a suction pressure to the nozzle of the ink gun 75 to draw air in through the nozzle in the reverse direction relative to the ink jet flow direction.

In valve state 4, "Top-Up", feed valve 67, purge valve 69 and gutter valve 71 are in the same states as for valve state 1 "run", but top-up valve 73 is open, connecting the solvent reservoir 17 to a suction inlet of suction device 65. In this state, the ink jet will continue while simultaneously solvent is transferred from the solvent bottle 17 to the ink reservoir 31 via the effect of the suction device 65.

Valve state 4 "Top-Up" is entered from valve state 1 "Run", and is maintained for long enough to supply 25 cubic cm of solvent (2% of normal maximum ink volume). The effect this will have on the ink viscosity depends on the quantity of ink in the ink reservoir 31. In order to allow time for mixing of the solvent with the ink in the ink reservoir 31, and for the reduced viscosity ink to travel the length (3 m) of the conduit 5 to the print head 3, and thus affect the time of flight, the ink system is not permitted to return to the top-up state until an appropriate period, e.g. 7 to 20 minutes, has passed. This prevents over dilution of the ink due to the delay in the change of the time of flight following a top-up sequence.

The value sequences used are:

| Pattern | Operation |
|---|---|
| a. Start-Up | |
| 0 Stand-By | Pump Start and Filter Test |
| 1 Run | Jet-Start |
| 2 Purge | Purge ink gun |
| 1 Run | Check for Phasing and ToF, Run |
| b. Run | |
| 1 Run | Run |
| c. Nozzle Clear | |
| 1 Run | Phasing or ToF failure in Start-Up |
| 3 Nozzle Suction | Nozzle Clear |
| 0 Stand-By | Return to beginning of Start-Up |
| d. Shut Down | |
| 1 Run | Run or 3 unsuccessful Nozzle Clears |
| 3 Nozzle Suction | Jet Stop |
| 0 Stand-By | Clear Gutter, then Pump Stop |
| e. Top-Up | |
| 1 Run | Run |
| 4 Top-Up | Solvent Top-Up |
| 1 Run | Run |

We claim:

1. A method of adjusting the operating amplitude of a modulation signal which influences the separation of drops from an ink jet of an ink jet printer, the method comprising:

a) determining the phase relationship between the modulation signal and the instants when successive said drops separate from the ink jet for a plurality of amplitudes of said modulation signal;

b) identifying the amplitude of the modulation signal at a predetermined characteristic point in the function of said phase relationship with said amplitude from the magnitude of the change of said phase relationship with the change of said amplitude; and c) selecting the operating amplitude for the modulation signal in accordance with said amplitude identified in said identifying step.

2. A method according to claim 1, including identifying the amplitudes of the modulation signal at two or more of said characteristic point.

3. A method according to claim 2, including identifying the amplitudes of the modulation signal at (i) a first said point in the region of the boundary between a correct modulation signal amplitude range and an under-modulation signal amplitude range, and (ii) a second point in the region of the boundary between the correct modulation signal amplitude range, and where in said selecting of the operating amplitude comprises selecting an amplitude between the amplitudes identified at the first and second points.

4. A method according to claim 3, in which said selecting of the operating amplitude comprises selecting an amplitude substantially midway between the first and second voltages.

5. A method according to claim 1, wherein said selecting of the operating amplitude comprises selecting an amplitude which varies from said amplitude identified in said identifying step by a predetermined amount.

6. A method according to claim 1 wherein said selecting of the operating amplitude comprises selecting an amplitude which varies from said amplitude identified in said identifying step by a predetermined offset.

7. A method according to claim 1 wherein said selecting of the operating amplitude comprises selecting an amplitude which varies from said amplitude identified in said identifying step by a predetermined factor.

8. A method according to claim 1 wherein said selecting of the operating amplitude comprises selecting an amplitude which varies from said amplitude identified in said identifying step an amount of amplitude variation which results in a predetermined offset of said phase relationship.

9. A method according to claim 1, in which said identifying step comprises identifying the amplitude of the modulation signal at the point in the function of said phase relationship with the amplitude of the modulation signal at which, for continued increases in the amplitude of the modulation signal, the rate of change of the determined phase relationship with change in the amplitude of the modulation signal falls below a threshold level.

10. A method according to claim 1, in which said identifying step comprises identifying the amplitude of the modulation signal at the point in the function of said phase relationship with the amplitude of the modulation signal at which, for continued decreases in the amplitude of the modulation signal, the rate of change of the determined phase relationship with change in the amplitude of the modulation signal falls below a threshold level.

11. A method according to claim 1, in which said determining step comprises performing repeatedly a cycle comprising varying the amplitude of the modulation signal in a predetermined direction by a preset amount and then determining said phase relationship.

12. An ink jet printer comprising:

an ink jet forming means for generating an ink jet and modulating it in accordance with a modulation signal to influence the break-up of the ink jet into drops;

charging means for providing, in accordance with a charging signal, an electric charge on the ink jet as it breaks up into drops;

detection means for detecting charged ink drops; and control means for:

(i) varying the amplitude of the modulation signal, (ii) controlling, at each of a plurality of amplitudes of the modulation signal, the phase relationship between the modulation signal and the charging signal and determining from the output of the detection means the phase relationship between the modulation signal at that amplitude and the instants when successive drops separate from the ink jet, (iii) identifying the amplitude of the modulation signal at a predetermined point in the function of (a) the phase relationship between the modulation signal and the instants when successive drops separate from the ink jet with (b) the amplitude of the modulation signal, and (iv) controlling the amplitude of the modulation signal during a subsequent printing operation in accordance with the identified amplitude at the predetermined point, wherein the control means identifies the predetermined point from the magnitude of change of the phase relationship between the modulation signal and the instants when successive drops separate from the ink jet with change in the amplitude of the modulation signal.

* * * * *

UNITED STATES PATENT AND TRADEMARK OFFICE

CERTIFICATE OF CORRECTION

PATENT NO. : 5,481,288

DATED : January 2, 1996

INVENTOR(S) : Keeling et al.

It is certified that error appears in the above-identified patent and that said Letters Patent is hereby corrected as shown below:

Column 7, line 21, "Will", should read --will--

Column 10, line 28, "hen" should read --then--

Column 16, line 58, --stationery-- should read --stationary--

Column 27, line 52, --Jigs-- should read --jigs--

Column 34, line 6, --tat-- should read --that--

Column 36, line 22, --solvent add-- should read --"solvent add"--

Column 37, line 29, --for than-- should read --for no more than--

Signed and Sealed this

Third Day of September, 1996

Bruce Lehman

*Attest:*

BRUCE LEHMAN

*Attesting Officer*

*Commissioner of Patents and Trademarks*